United States Patent [19]

Naito

[11] Patent Number: 4,693,954

[45] Date of Patent: Sep. 15, 1987

[54] HEAT DEVELOPABLE LIGHT-SENSITIVE MATERIALS WITH HIGH BOILING POINT SOLVENTS AND BASE OR BASE PRECURSORS

[75] Inventor: Hideki Naito, Kanagawa, Japan

[73] Assignee: Fuji Photo Film Co., Ltd., Kanagawa, Japan

[21] Appl. No.: 781,077

[22] Filed: Sep. 27, 1985

[30] Foreign Application Priority Data

Sep. 27, 1984 [JP] Japan ..... 59-202265

[51] Int. Cl.[4] ..... G03C 5/54; G03C 1/40; G03C 7/26

[52] U.S. Cl. ..... 430/203; 430/220; 430/617

[58] Field of Search ..... 430/203, 617, 619, 220

[56] References Cited

U.S. PATENT DOCUMENTS 3,985,565 10/1976 Gabrielsen et al. ..... 430/203
4,409,316 10/1983 Zeller-Pendrey et al. ..... 430/617
4,430,415 2/1984 Aono et al. ..... 430/203
4,478,927 10/1984 Naito et al. ..... 430/203
4,560,644 12/1985 Naito et al. ..... 430/203

*Primary Examiner*—Richard L. Schilling
*Attorney, Agent, or Firm*—Sughrue, Mion, Zinn, Macpeak, and Seas

[57] ABSTRACT

A heat developable light-sensitive material having both (a) a light-sensitive element which contains at least one light-sensitive silver halide emulsion layer and at least one image forming substance capable of forming a diffusible dye and (b) a dye fixing element capable of fixing the formed diffusible dye on the same side of one support, in such relation that a diffusible dye may permeate the dye fixing element (b) by diffusing from the light-sensitive element (a).

The light-sensitive material of the present invention has a simple structure and does not require complicated procedures for its use or excess structural elements. Photographic images can be formed using the light-sensitive material in a short period of time by means of a simple photographic treatment.

11 Claims, 21 Drawing Figures

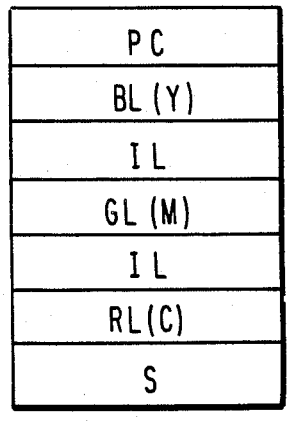

FIG.1

| |
|---|
| PC |
| BL (Y) |
| IL |
| GL (M) |
| IL |
| RL(C) |
| S |

FIG.2

| |
|---|
| PC |
| BL (Y) |
| YF |
| GL(M) |
| IL |
| RL(C) |
| S |

FIG.3

| |
|---|
| PC |
| BL (Y) |
| IL |
| RL (C) |
| IL |
| GL (M) |
| S |

FIG.4

| |
|---|
| PC |
| GL(Y) |
| IL |
| RL (M) |
| IL |
| IRL(C) |
| S |

FIG.5

| |
|---|
| PC |
| GL(Y) |
| IL |
| RL(C) |
| IL |
| IRL (M) |
| S |

FIG.6

| |
|---|
| PC |
| GL(Y) |
| IL |
| IRL(M) |
| IL |
| RL(C) |
| S |

FIG.7

| |
|---|
| PC |
| GL(Y) |
| IL |
| RL (M) |
| IL |
| IRL (C) |
| IL |
| AHL |
| S |

FIG.8

| |
|---|
| PC |
| BL |
| YL |
| IL |
| GL |
| ML |
| IL |
| RL |
| CL |
| S |

FIG.9

| |
|---|
| PC |
| RL (C) |
| IL |
| GL(M) |
| IL |
| BL(Y) |
| S |

FIG.10

| |
|---|
| PC |
| R |
| W |
| Em |
| S(T) |

FIG.11

| |
|---|
| R |
| W |
| P |
| Em |
| S(T) |

FIG.12

| |
|---|
| PC |
| R |
| W |
| P |
| Em |
| S(T) |

FIG. 13

| |
|---|
| S(T) |
| R |
| HS |
| P |
| Em |
| S(T) |

FIG. 14

| |
|---|
| S(T) |
| R |
| HS |
| P |
| Em |
| S(O) |

FIG. 15

| |
|---|
| S(O) |
| R |
| P |
| Em |
| S(T) |

FIG. 16

| |
|---|
| PC |
| R |
| W |
| Em |
| S(T) |
| CB(T) |

FIG. 17

| |
|---|
| S(T) |
| R |
| P |
| Em |
| S(T or O) |
| CB(O) |

FIG. 18

| |
|---|
| PC |
| Em |
| P |
| R |
| S(T or O) |

FIG. 19

| |
|---|
| PC |
| Em |
| P |
| R |
| S(O) |
| CB(T or O) |

FIG. 20

| |
|---|
| PC |
| Em |
| W |
| R |
| S(T) |
| CB(T) |

FIG. 21

| |
|---|
| PC |
| Em |
| P |
| R |
| W |
| CB(T or O) |
| S(T or O) |

HEAT DEVELOPABLE LIGHT-SENSITIVE MATERIALS WITH HIGH BOILING POINT SOLVENTS AND BASE OR BASE PRECURSORS

FIELD OF THE INVENTION

The present invention relates to light-sensitive materials for forming color images by heat development, in particular, to laminate type heat developable light-sensitive materials having a light-sensitive element and a dye fixing element both of which elements are provided on the same support.

BACKGROUND OF THE INVENTION

Photography using a silver halide has been most widely utilized, since the photographic characteristics thereof such as sensitivity, gradation control, etc., are superior to those of other photographic systems such as electrophotography or a diazo process. Recently, an improved photographic technique has been developed capable of simply and rapidly forming an image, where image formation using a silver halide-containing light-sensitive material is carried out by means of a dry process under heat instead of a conventional wet process using a developing agent or the like. Such heat developable light-sensitive materials using silver halides are well known in this technical field.

Various heat developable light-sensitive materials and processes for their use are described, for example, in *Shashin Kogaku no Kiso,* pp. 553–555 (Corona Co., 1979); *Eizo Joho* (April, 1978), page 40; *Neblett's Handbook of Photography and Reprography,* pp. 32–33 (7th Ed., Van Nostrand Reinhold Company).

Many processes have been proposed for formation of color images in a dry system, for example, those described in West German Patent Application (OLS) Nos. 3,215,485 and 3,217,853, European Pat. Nos. 66,282, 67,455, 79,056 and 76,492. These conventional materials, however, have several disadvantages. One is the commercial disadvantage that a photographic element and a dye fixing element are formed on separate supports and thus two supports are required. Another disadvantage is that an additional step is required in which the photographic element and the dye fixing element are lapped accurately after development. Still another disadvantage is that a long time is required for completing the formation of images.

SUMMARY OF THE INVENTION

One object of the present invention is to provide heat developable light-sensitive materials capable of forming images in a short period of time by means of a simple treatment.

Another object of the present invention is to provide simplified heat developable light-sensitive materials which do not require any complicated or excess structural elements.

These and other objects of the present invention have now been attained by a heat developable light-sensitive material comprising a support having thereon (1) a light-sensitive element containing at least one light-sensitive silver halide emulsion layer and at least one image forming substance capable of forming a diffusible dye, and (2) a dye fixing element.

BRIEF DESCRIPTION OF THE DRAWINGS

FIGS. 1 to 9 show layer structures of light-sensitive elements of the heat developable light-sensitive materials according to the present invention.

FIGS. 10 to 21 show layer structures of the heat developable light-sensitive materials according to the present invention.

In the layer structures as shown in FIGS. 10 to 21, Em shows a light-sensitive element composed of two or more layers as shown in FIGS. 1 to 9, PC shows a protective layer, CB shows a resistance heating element layer, R shows a dye fixing layer, W shows a white reflection layer, P shows a peeling layer, S shows a support (in which T is a transparent support and O is an opaque support), and HS shows a layer containing a dye transfer assistant.

DETAILED DESCRIPTION OF THE INVENTION

The present invention will now be explained in detail in the following description.

In the light-sensitive material of the present invention, the dye fixing element and the light-sensitive element are provided on the same support in such relation that the diffusible dye formed in the light-sensitive element may permeate the dye fixing element as it diffuses from the silver halide element upon development, which means that the two elements are adjacent and laminated to each other, or alternatively, the two elements are each laminated to an intermediate layer which does not inhibit the diffusion and permeation of the image forming dye from the light-sensitive element to the dye fixing element.

The silver halides used in the present invention may be any silver chloride, silver bromide, silver iodide, silver chlorobromide, silver chloroiodide, silver iodobromide and silver chloroiodobromide. These silver halide grains may either have a uniform halogen composition or have a structure with different inner and outer halogen compositions, as described in Japanese Patent Application (OPI) Nos. 154232/82, 108533/83, 48755/84 and 52237/84 (the term "OPI" as used herein refers to a "published unexamined Japanese patent application"), U.S. Pat. No. 4,433,048 and European Pat. No. 100,984. Regarding the shape of the silver halide grains, tabular grains having a thickness of about 0.5 μm or less, a diameter of at least about 0.6 μm and an average aspect ratio of about 5 or more (as described, e.g., in U.S. Pat. Nos. 4,414,310 and 4,435,499 and West German Patent Application (OLS) No. 3,241,646 A1) may be used in the present invention. In addition, a monodisperse emulsion, containing silver halide grains of nearly uniform grain size distribution (as described, e.g., in Japanese Patent Application (OPI) Nos. 178235/82, 100846/83 and 14829/83, International Patent Publication No. 83/02338A1, and European Pat. Nos. 64,412A3 and 83,377A1) may also be used in the present invention. Furthermore, two or more kinds of silver halides each having different crystal habit, halogen composition, grain size and grain size distribution may be used together; and it is also possible to blend two or more kinds of monodisperse emulsions each having different grain size thereby to suitably regulate the gradation of an image to be formed.

The average grain size of silver halide grains to be used in the present invention is preferably within the range of about 0.001 μm to 10 μm, more preferably about 0.001 μm to 5 μm. The silver halide emulsion may be prepared by any conventional means such as an acid method, a neutral method or an ammonia method. For the reaction of a soluble silver salt and a soluble halogen salt, any of a single jet method or a double jet method or a combination thereof may be used. In addition, a reverse mixing method where silver halide grains are formed in the presence of an excess of silver ion; or a controlled double jet method where the value of pAg is kept constant may also be used. In order to accelerate the growth of silver halide grains in the reaction, the concentration of the silver salt and halogen salt to be added as well as the amount thereof and the rate of addition thereof may be elevated appropriately, as disclosed in Japanese Patent Application (OPI) Nos. 142329/80 and 158124/80 and U.S. Pat. No. 3,650,757.

Silver halide grains of epitaxial over grown type may be used in the present invention, as disclosed in Japanese Patent Application (OPI) No. 16124/81 and U.S. Pat. No. 4,094,684.

When a silver halide alone is used in the present invention, i.e., without the combined use of an organic silver salt oxidizing agent, it is preferred to use silver chloroiodide, silver iodobromide and silver chloroiodobromide exhibiting an X-ray diffraction pattern of silver iodide crystals.

Such silver halides may be formed, for example, by first adding a silver nitrate solution to a potassium bromide solution to form silver bromide grains, and then adding potassium iodide thereto, to obtain silver iodobromide having this characteristic.

In the step of forming silver halide grains to be used in the present invention, a solvent for dissolving a silver halide may be used, such as ammonia or an organic thioether derivative as described in Japanese Patent Publication No. 11386/72, or a sulfur-containing compound as described in Japanese Patent Application (OPI) No. 144319/78.

During the step of formation of silver halide grains or physical ripening thereof, a cadmium salt, a zinc salt, a lead salt, a thallium salt may be used.

In addition, in order to improve any high intensity reciprocity failure or low intensity reciprocity failure, a water-soluble iridium salt such as iridium (III, IV) chloride or ammonium hexachloroiridate, or a water-soluble rhodium salt such as rhodium chloride may further be used in preparing the silver halide grains or their physical ripening.

Soluble salts, if any, may be removed from the silver halide emulsion, after the formation of silver halide precipitates or after the physical ripening thereof, by noodle washing or by a sedimentation method.

The silver halide emulsion may be used without being postripened, but in general, the emulsion is used after being chemically sensitized. An emulsion for a light-sensitive material, in general, may be ripened by conventional sulfur sensitization, reduction sensitization or noble metal sensitization or a combination of said conventional sensitization means, which may be carried out in the presence of a nitrogen-containing heterocyclic ring compound as described, e.g., in Japanese Patent Application (OPI) Nos. 126526/83 and 215644/83.

The silver halide emulsion to be used in the present invention may be any of a surface latent image type where a latent image is formed mainly on the surface of silver halide grains, or an internal latent image type where a latent image is formed mainly in the inner part of the grains. In addition, a direct reversal emulsion comprising a combination of the internal latent image type emulsion and a nucleating agent may also be used in the present invention. Various kinds of internal latent image type emulsions which are suitable are described, e.g., in U.S. Pat. Nos. 2,592,250 and 3,761,276, Japanese Patent Publication No. 3534/83 and Japanese Patent Application (OPI) No. 136641/82. Preferred nucleating agents which may be used in the present invention in combination with the internal latent image type emulsion are described, e.g., in U.S. Pat. Nos. 3,227,552, 4,245,037, 4,255,511, 4,266,013 and 4,276,364 and West German Patent Application (OLS) No. 2,635,316.

The amount of the light-sensitive silver halide in the light-sensitive layer of the present invention is from about 1 mg/m$^2$ to 10 g/m$^2$, preferably about 50 mg/m$^2$ to 8 g/m$^2$, calculated in terms of the content of silver therein.

In the present invention, an organic metal salt which is relatively stable to light may be used as an oxidizing agent, together with the light-sensitive silver halide. In this case, it is necessary that the light-sensitive silver halide and organic metal salt be in close relation, e.g., either kept in contact with each other or kept near to each other. An organic silver salt is especially preferably used as the organic metal salts. Although not desiring to be bound by theory, when an organic silver salt is used in the heat developable light-sensitive material according to the present invention, when the exposed light-sensitive material is heated at a temperature of about 80° C. or higher, preferably about 100° C. or higher, the organic silver salt oxidizing agent is considered to participate in a redox reaction occurring under heat in the presence of a silver halide latent image as a catalyst.

Examples of organic compounds which may be used as the organic component of said organic silver salt oxidizing agents include aliphatic or aromatic carboxylic acids, thiocarbonyl group-containing compounds having a mercapto group or α-hydrogen and imino group-containing compounds.

Typical examples of aliphatic carboxylic acids used as the organic component include behenic acid, stearic acid, oleic acid, lauric acid, capric acid, myristic acid, palmitic acid, maleic acid, fumaric acid, tartaric acid, furoinic acid, linoleic acid, linolenic acid, adipic acid, sebacic acid, succinic acid, acetic acid, butyric acid or camphoric acid. In addition, silver salts of halogen-substituted or hydroxyl-substituted derivatives of these fatty acids or salts of thioether group-containing aliphatic carboxylic acids may also be used in the present invention.

Examples of aromatic carboxylic acids or other carboxyl-containing compounds used as the organic component of the organic silver salts include benzoic acid, 3,5-dihydroxybenzoic acid, o-, m- or p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid or 3-carboxymethyl-4-methyl-4-thiazoline-2-thione.

Examples of mercapto- or thiocarbonyl-containing organic components of the organic silver salt include 3-mercapto-4-phenyl-1,2,4-triazole, 2-mercaptobenzimidazole, 2-mercapto-5-aminothiadiazole, 2-mercaptobenzothiazole, s-alkylthioglycolic acid in which the alkyl moiety has about 12 to 22 carbon atoms, dithiocarboxylic acids such as dithioacetic acid, thioamides such as thiostearoamide, 5-carboxy-1-methyl-2-phenyl-4-thiopyridine, mercaptotriazine, 2-mercaptobenzoxazole, mercaptooxadiazole or 3-amino-5-benzylthio-1,2,4-triazole and other mercapto compounds, as described in U.S. Pat. No. 4,123,274.

Examples of imino-containing compounds which may be used as the organic component include benzotriazole or derivatives thereof as described in Japanese Patent Publication Nos. 30270/69 and 18416/70, for example, benzotriazole, methylbenzotriazole and other alkyl-substituted benzotriazoles, 5-chlorobenzotriazole and other halogen-substituted benzotriazoles, and butylcarboimidobenzotriazole and other carboimidobenzotriazoles; nitrobenzotriazoles as described in Japanese Patent Application (OPI) No. 118639/83; sulfobenzotriazole, carboxybenzotriazole or salts thereof, and nitrobenzotriazole as described in Japanese Patent Application (OPI) No. 118638/83; and 1,2,4-triazole, 1H-tetrazole, carbazole, saccharin, imidazole and derivatives thereof as described in U.S. Pat. No. 4,220,709.

In addition, silver salts as described in *Research Disclosure* RD 17029 (June, 1978), organic metal salts other than silver salts such as copper stearate, and silver salts of alkyl-containing carboxylic acids such as phenylpropiolic acid as described in Japanese Patent Application (OPI) No. 113235/85 may also be used in the present invention.

The amount of organic silver salt used in the light-sensitive material of the present invention is about 0.01 to 10 mols, preferably about 0.01 to 1 mol, per mol of light-sensitive silver halide used. The total amount of the light-sensitive silver halide and organic silver salt is suitably from about 50 mg/m$^2$ to 10 g/m$^2$.

The silver halide to be used in the present invention may be spectrally sensitized with a methine dye or other sensitizing dye. Sensitizing dyes which may be used for spectral sensitization include cyanine dyes, merocyanine dyes, complex cyanine dyes, complex merocyanine dyes, holopolar cyanine dyes, hemicyanine dyes, styryl dyes and hemioxonol dyes. Especially preferred dyes are cyanine dyes, merocyanine dyes and complex merocyanine dyes. These dyes may contain any conventional basic heterocyclic nucleus, which is typically used in conventional cyanine dyes, including a pyrroline nucleus, an oxazoline nucleus, a thiazoline nucleus, a pyrrole nucleus, an oxazole nucleus, a thizole nucleus, a selenazole nucleus, an imidazole nucleus, a tetrazole nucleus, or a pyridine nucleus; these nuclei fused with an alicyclic hydrocarbon ring; and these nuclei fused with an aromatic hydrocarbon ring, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, or a quinoline nucleus. These nuclei may optionally have substituent(s) on their carbon atom(s).

The merocyanine dyes and complex merocyanine dyes may contain a ketomethylene structural nucleus, such as 5- or 6-membered heterocyclic nuclei including a pyrazolin-5-one nucleus, a thiohydantoin nucleus, a 2-thiooxazolidine-2,4-dione nucleus, a thiazolidine-2,4-dione nucleus, a rhodanine nucleus or a thiobarbituric acid nucleus.

The sensitizing dyes may be used alone or in combination of two or more sensitizing dyes. The combination use of such sensitizing dyes is often utilized for the purpose of supersensitization.

The light-sensitive emulsion of the present invention may further contain, together with the sensitizing dye, a dye which itself does not have any spectral sensitization activity or a compound which does not itself substantially absorb visible light but exhibits a supersensitization activity. For example, the present emulsion may contain an aminostyryl compound substituted by a nitrogen-containing heterocyclic group (e.g., as described in U.S. Pat. Nos. 2,933,390 and 3,635,721), an aromatic organic acid/formaldehyde condensation product (e.g., as described in U.S. Pat. Nos. 3,743,510), a cadmium salt or an azaindene compound. In particular, the combinations described in U.S. Pat. Nos. 3,615,613, 3,615,641, 3,617,295 and 3,635,721 are especially preferred.

In order to incorporate the sensitizing dye into the silver halide light-sensitive emulsion of the present invention, the dye may be dispersed directly in the emulsion, or alternatively, the dye may be first dissolved in a solvent such as water, methanol, ethanol, acetone or methyl cellosolve or a mixture thereof and thereafter the resultant solution added to the emulsion. In addition, the sensitizing dye may be first dissolved in a solvent which is immiscible with water such as phenoxyethanol, and the resultant solution dispersed in water or in a hydrophilic colloid, and thereafter the resultant dispersion added to the emulsion. In another method for incorporation of the sensitizing dye into the present photographic emulsion, the sensitizing dye is admixed with a lipophilic compound such as a dye providing compound, and the sensitizing dye is incorporated into the emulsion together with the dye providing compound. When the sensitizing dye is dissolved, another sensitizing dye used in combination may be dissolved separately in a separate solvent, or alternatively, the mixture of sensitizing dyes to be used together may be dissolved in the same solvent. When the sensitizing dye is added to an emulsion, two or more sensitizing dyes may be added simultaneously in the form of a mixture thereof, each sensitizing dye may be added separately, or each sensitizing dye may be added together with any other additives. Regarding the point in time when the sensitizing dye is added to the emulsion, the dye may be added during chemical ripening or before or after chemical ripening. Alternatively, the dye may be added to the emulsion before or after the formation of silver halide grain nuclei, as disclosed in U.S. Pat. Nos. 4,183,756 or 4,225,666.

The amount of the sensitizing dye added to the emulsion is, in general, about $10^{-8}$ to $10^{-2}$ mol per mol of silver halide.

In the light-sensitive material of the present invention, various dye providing substances may be used as an image forming substance capable of forming a diffusible dye.

In one embodiment, the dye providing substance used in the present invention is a combination of a developing agent and a coupler. In this system, an oxidized developing agent formed by the oxidation reduction reaction of a silver salt and a developing agent reacts with a coupler to form a dye, as is well known in the art and described in various publications.

Examples of such developing agents and couplers are described in detail, e.g., in T. H. James, *The Theory of the Photographic Process,* pp. 291–334 and pp. 354–361 (4th Ed., 1977), and Shinichi Kikuchi, *Photographic Chemistry,* pp. 284–295 (Kyoritsu Publishing, 4th Ed., 1967), etc.

In another embodiment of the present invention, the dye providing substance is a silver dye compound comprising a combination of an organic silver salt and a dye.

Examples of such silver dye compounds are described in *Research Disclosure* (May, 1978) (RD-16966), pp. 54–58.

In still another embodiment of the present invention, the dye providing substance is an azo dye which is conventionally used in a heat developable silver dye bleaching method. Examples of such azo dyes and the bleaching process are described in U.S. Pat. No. 4,235,957 and *Research Disclosure* (April, 1976) (RD-14433), pp. 30 to 32.

In a further embodiment of the present invention, the dye providing substance is a leuco dye described in U.S. Pat. Nos. 3,985,565 and 4,022,617.

In a still further embodiment of the present invention, the dye providing substance is a compound capable of imagewise releasing and diffusing a diffusible dye represented by general formula (I):

$$(\text{Dye—X})_n\text{—Y} \qquad \text{(I)}$$

wherein Dye represents a dye residue or a dye precursor residue; X represents a single bond or a bonding group; Y represents a group capable of providing a difference in diffusibility of the compound of formula $(\text{Dye—X})_n$—Y, corresponding to or reversely corresponding to the imagewise distribution of a light-sensitive silver halide having a latent image, or alternatively Y represents a group capable of releasing Dye and providing a difference in diffusibility between the released Dye and the compound of formula $(\text{Dye—X})_n$—Y; n is an integer of 1 or 2; and when n is 2, each (Dye—X) may be the same or different.

Various examples of dye providing substances of the formula (I) are known. For instance, U.S. Pat. Nos. 3,134,764, 3,362,819, 3,597,200, 3,544,545 and 3,482,972 describe dye developers comprising a combination of a hydroquinone type developing agent and a dye component; Japanese Patent Application (OPI) No. 63618/76 describes a system in which a diffusible dye is released by an intramolecular nucleophilic substitution reaction; and Japanese Patent Application (OPI) No. 11628/74 describes a system in which a diffusible dye is released by an intramolecular rearrangement reaction of an isoxazolone ring. In each of these systems, a diffusible dye is released or diffused in a nondeveloped part, but the dye is neither released nor diffused in a developed part. In addition, both development and release or diffusion of dye occur simultaneously in these systems and, therefore, it is extremely difficult to obtain an image of high S/N ratio. Under the circumstances and in order to overcome this disadvantage, another system has been proposed, in which a dye releasing compound is first converted into an oxidized form having no dye releasing ability and the oxidized compound is used together with a reducing agent or a precursor thereof, and, after development, the compound is reduced with the reducing agent, which has remained unoxidized, thereby to release a diffusible dye from the compound. Examples of such materials are described, for example, in Japanese Patent Application (OPI) Nos. 110827/78, 130927/79, 164342/81 and 35533/78.

On the other hand, still another dye providing substance may be used which releases a diffusible dye in a developed part of the material. For instance, British Pat. No. 1,330,524, Japanese Patent Publication No. 39165/73, U.S. Pat. No. 3,443,940, European Pat. Nos. 79,056 and 67,455 and British Pat. No. 2,100,016 describe a method for releasing a diffusible dye by reaction of a coupler having a leaving group of a diffusible dye and an oxidized developing agent; and U.S. Pat. No. 3,227,550 and Japanese Patent Application (OPI) No. 149046/83 describe a method for forming a diffusible dye by reaction of a coupler having a leaving group of a nondiffusible group and an oxidized developing agent.

However, such dye providing systems requiring such color developing agents have a severe disadvantage since the image formed is often stained due to an oxidized and decomposed product of the used developing agent. In order to overcome this problem, other dye releasing compounds which themselves have a reductivity and do not require any developing agent have been proposed. Such dye releasing compounds are described, e.g., in European Pat. Nos. 76,492 and 66,282 and West German Pat. No. 3,215,485. These dye releasing compounds may be used in the present invention as the dye providing substance and, in addition, other compounds may also be used, as described in U.S. Pat. Nos. 3,928,312, 4,053,312, 4,055,428, 4,336,322, 3,725,062, 3,728,113, 3,443,939, and Japanese Patent Application (OPI) Nos. 3819/78, 104343/76 and 116537/83 and *Research Disclosure,* No. 17465 (October, 1978).

In the present invention, the dye providing substance as described above may be incorporated into layer(s) of a light-sensitive material in a known manner, for example, according to the method described in U.S. Pat. No. 2,322,027. In this case, an organic solvent having a high boiling point or an organic solvent having a low boiling point may be used.

For instance, the dye providing substance is first dissolved in an organic solvent having a high boiling point such as an alkyl phthalate (e.g., dibutyl phthalate or dioctyl phthalate), a phosphate (e.g., diphenyl phosphate, triphenyl phosphate, tricresyl phosphate or dioctylbutyl phosphate), a citrate (e.g., tributyl acetyl citrate), a benzoate (e.g., octyl benzoate), an alkylamide (e.g., diethyllaurylamide), a fatty acid ester (e.g., dibutoxyethyl succinate or dioctyl azelate) or a trimesate (e.g., tributyl trimesate); or in an organic solvent having a low boiling point of about 30° C. to 160° C., such as a lower alkyl acetate (e.g., ethyl acetate or butyl acetate) or ethyl propionate, secondary butyl alcohol, methyl isobutyl ketone, β-ethoxyethyl acetate, methyl cellosolve acetate or cyclohexanone; and thereafter the resultant solution is dispersed in a hydrophilic colloid. A mixture of an organic solvent having a high boiling point and an organic solvent having a low boiling point may also be used.

In addition, a dispersion method using a polymer, as described in Japanese Patent Publication No. 39853/76 and Japanese Patent Application (OPI) No. 59943/76 may be used for incorporation of the dye providing substance into the photographic material of the present invention. When the dye providing substance is dispersed in a hydrophilic colloid, various surfactants may be used, and examples of such surfactants are described in U.S. Pat. No. 4,511,650, Col. 18–19.

The amount of an organic solvent having a high boiling point used in the present invention is 10 g or less, preferably is 5 g or less, per g of the dye providing substance which is used in the present invention.

In the present invention various kinds of image forming accelerators may also be used. In particular, it is preferred to incorporate a base or a base precursor thereof in the light-sensitive element of the present invention. In addition, it is also preferred to incorporate the base or base precursor not only in the light-sensitive element but also in the dye fixing element of the photographic material of the present invention. By the incorporation of the base or base precursor into the photographic material of the present invention, the formation of an imagewise diffusible dye by heat development and/or diffusion of the diffusible dye formed into the dye fixing element may be accelerated.

The base or base precursors may be used alone or in combination of two or more.

The amount of the base or base precursor used may vary over a wide range. The useful range thereof is about 0.01 to 50 wt%, preferably about 0.5 to 20 wt%, on the basis of the total weight of the coated layers of the laminate type photographic material of the present invention. The base or base precursor is not necessarily added uniformly in every layer of the present photographic material, but the amount thereof in each layer may suitably be varied as desired.

In the light-sensitive material of the present invention, other image forming accelerators may be used. Image forming accelerators have various functions, for example, to accelerate the oxidation reduction reaction of a silver salt oxidizing agent and a reducing agent, to accelerate the formation of a dye from a dye providing substance or the decomposition of the formed dye or the release of a diffusible dye from a dye providing substance, or to accelerate the transfer of the formed dye from the light-sensitive element layer to the dye fixing element layer. According to the physicochemical functions of these accelerators, they may be classified as bases or base precursors, nucleophilic compounds, oils, thermal solvents, surfactants and compounds having a mutual action with silver or silver ion. In this connection, such accelerator substances generally have composite functions and have two or more accelerating functions as mentioned above.

Image forming accelerators are classified by function into the following groups, and examples within the classified groups are illustrated. However, the following classification is not critical, and in practice, many compounds often have plural functions.

(a) Bases:

Examples of preferred bases are inorganic bases such as alkali metal or alkaline earth metal hydroxides, secondary or tertiary phosphates, borates, carbonates, quinolinates, metaborates; ammonium hydroxides; quaternary alkylammonium hydroxides; and other metal hydroxides; and organic bases such as aliphatic amines (e.g., trialkylamines, hydroxylamines, aliphatic polyamines); aromatic amines (e.g., N-alkyl-substituted aromatic amines, N-hydroxyalkyl-substituted aromatic amines and bis[p-(dialkylamino)phenyl]methanes); heterocyclic amines, amidines, cyclic amidines, guanidines, cyclic guanidines. Among them, bases having a pKa value of 8 or more are especally preferred.

(b) Base precursors:

As base precursors, those capable of releasing a base through some reaction under heat are preferably used, including a salt of an organic acid and a base capable of decarboxylating and decomposing under heat, or a compound capable of decomposing and releasing an amine by an intramolecular nucleophilic substitution reaction, Lossen rearrangement, Beckmann rearrangement or other reaction. Examples of preferred base precursors are salts of trichloroacetic acid, as described in British Pat. No. 998,949; salts of α-sulfonylacetic acid as described in U.S. Pat. No. 4,060,420; salts of propiolic acids as described in Japanese Patent Application (OPI) No. 180537/84; 2-carboxycarboxamide derivatives as described in U.S. Pat. No. 4,088,496; salts of pyrolytic acids, in which an alkali metal or alkaline earth metal component is used besides an organic base, as a base component, as described in Japanese Patent Application (OPI) No. 195237/84; hydroxame carbamates as described in U.S. Pat. No. 4,511,650, in which a Lossen rearrangement occurs; and aldoxime carbamates capable of forming a nitrile under heat, as described in U.S. Pat. No. 4,499,180. In addition, other base precursors as described in British Pat. No. 998,945, U.S. Pat. No. 3,220,846, Japanese Patent Application (OPI) No. 22625/75 and British Pat. No. 2,079,480 are also useful.

(c) Nucleophilic compounds:

Water and water releasing compounds, amines, amidines, guanidines, hydroxylamines, hydrazines, hydrazides, oximes, hydroxamic acids, sulfonamides, active methylene compounds, alcohols and thiols may be used, as well as salts and precursors of these compounds.

(d) Oils:

Organic solvents having a high boiling point ("plasticizers") which are used for emulsification and dispersion of hydrophobic compounds may be used in the present invention.

(e) Thermal solvents:

Thermal solvents are those which are solid at room temperature but are capable of melting at developing temperature to be able to act as a solvent, including ureas, urethanes, amides, pyridines, sulfonamides, sulfonsulfoxides, esters, ketones, ethers or other compounds, which are solid at about 40° C. or lower.

(f) Surfactants:

Pyridinium salts, ammonium salts, phosphonium salts as described in Japanese Patent Application (OPI) No. 74547/84; and polyalkylene oxides as described in Japanese Patent Application (OPI) No. 57231/84 may be used.

(g) Compounds having mutual action with silver or silver ion:

Imides; nitrogen-containing heterocyclic compounds as described in Japanese Patent Application (OPI) No. 177550/84; and thiols, thioureas and thioethers as described in Japanese Patent Application (OPI) No. 111636/84 may be used.

Such image forming accelerators may be incorporated in either the light-sensitive element or the dye fixing element of the present invention, or may be incorporated in both of these elements. The accelerators may be incorporated in any of an emulsion layer, an intermediate layer, a protective layer, a dye fixing layer or an adjacent layers to any of these layers.

The image forming accelerator may be used alone, or alternatively, several accelerators may be used together, and, in general, it is preferred to use a mixture of image forming accelerators to obtain a greater image forming acceleration effect. In particular, the combined use of a base or base precursor and another accelerator is preferred, as an extremely remarkable image forming acceleration effect may be attained.

The dye fixing element of the present invention preferably contains at least one mordanting layer containing a conventional mordant selected from those which may be used in a color diffusion transfer process. In particular, polymer mordants are especially preferred among conventional mordants, including polymers containing a tertiary amino group, polymers having a nitrogen-containing heterocyclic ring and quaternary cation-containing polymers thereof.

Examples of polymers containing a tertiary imidazole group-containing vinyl monomer unit are described in Japanese Patent Application (OPI) No. 118834/85 and U.S. Pat. Nos. 4,282,305, 4,115,124 and 3,148,061.

Preferred examples of polymers containing a quaternary imidazolium salt-containing vinyl monomer unit are described in British Pat. Nos. 2,056,101, 2,093,041 and 1,594,961, U.S. Pat. Nos. 4,124,386, 4,115,124, 4,273,853 and 4,450,224 and Japanese Patent Application (OPI) No. 28225/73.

Examples of other polymers containing a quaternary ammonium salt-containing vinyl monomer unit are described, e.g., in U.S. Pat. Nos. 3,709,690, 3,898,088 and 3,958,995, Japanese Patent Application (OPI) Nos. 57836/85 and 60643/85 and Japanese Patent Application No. 91620/84 (U.S. patent application Ser. No. 731,695, filed on May 8, 1985).

The dye fixing element of the present invention may have, in addition to an mordanting layer, an auxiliary layer such as a white reflection layer, a black shielding layer, a peeling layer and a protective layer, if necessary.

In addition, a dye transfer assistant may optionally be incorporated in the dye fixing element, if desired, or a water absorbing layer or a dye transfer assistant-containing layer may also be provided in the dye fixing element to control the dye transfer assistant. These layers may be provided adjacent to the dye fixing layer, or may be coated on the dye fixing layer with an intermediate layer therebetween.

The dye fixing layer of the present invention may comprise, if desired, two or more layers each containing a different mordant having a different mordanting ability.

One or more layers in the dye fixing element of the present invention may contain a base and/or a precursor thereof, a hydrophilic thermal solvent or a high boiling point solvent alone or in combination to accelerate the dye transfer therein. In addition, the dye fixing element may contain a fading preventing agent, a UV absorbent, a vinyl compound dispersion to increase the dimensional stability, a fluorescent whitening agent, or other conventional additives commonly used in dye fixing layers.

In order to attain high Dmax, it is desirable that one or more layers in the dye fixing element of the present invention contain a base and/or a precursor thereof. The suitable amount of the base and/or base precursor used is 0.1 $g/m^2$ to 0.6 $g/m^2$ per $\mu$ of coated layer film thickness of the dye fixing element.

When such amount of the base and/or base precursor is added to the dye fixing element, cracks tend to occur in the coated layer of the dye fixing element in the storage of lapse of time. In order to prevent cracks from occurring, it is found that it is effective that an organic solvent having a high boiling point is added to the dye fixing layer, especially to the base and/or base precursor. Preferable form of the organic solvent having a high boiling point added is a very little drop form. The amount of the organic solvent having a high boiling point added is 0.25 $g/m^2$ to 10 $g/m^2$, preferably 0.5 $g/m^2$ to 5 $g/m^2$.

Especially when the dye fixing element contains the white reflection layer, a large amount of base and/or base precursor should be added to make the thickness of the white reflection layer thick. As a result, the white reflection layer tends to be cracked. However, the occurrence of cracks is effectively prevented by using the above organic solvent having a high boiling point.

As the above described organic solvent having a high boiling point, various solvents may be used, and examples of such solvents are illustrated in the present specification as using for dispersion of the dye providing substance.

The binder used in the above described layers is preferably a hydrophilic binder, and typically used transparent or semitransparent hydrophilic colloids include natural substances such as proteins, e.g., gelatin, gelatin derivatives, polyvinyl alcohol and cellulose derivatives, and polysaccharides, e.g., starches and gum arabic; and synthetic polymer substances such as water-soluble polyvinyl compounds, e.g., dextrin, pullulan, polyvinyl alcohol, polyvinyl pyrrolidone and acrylamide polymer. In particular, gelatin and polyvinyl alcohols are effective among them.

The dye fixing element of the present invention may further contain, in addition to the above described layers, a reflection layer containing a white pigment such as titanium oxide, a neutralizing layer or a neutralization timing layer, in accordance with the use and the object of the photographic material. Additional layers may be provided not only in the dye fixing element but also in the light-sensitive element of the present invention. The structure and characteristics of neutralizing layer and neutralization timing layer is described, for example, in U.S. Pat. Nos. 2,983,606, 3,362,819, 3,362,821, 3,415,644 and Canadian Pat. No. 928,559.

The dye fixing element of the present invention preferably contains a transferring assistant as described hereinafter. The transferring assistant may be incorporated in the dye fixing layer or in any other layers additionally provided in the dye fixing element.

In a light-sensitive material in which a dye to be transferred is hydrophilic, when the dye transfer assistant is incorporated in the light-sensitive element and/or the dye fixing element, a hydrophilic thermal solvent is used as the dye transfer assistant, and the hydrophilic dye may be transferred to the dye fixing element and fixed therein under heat in the presence of the hydrophilic thermal solvent (or dye transfer assistant).

In an image formation system where a dye formed is transferred to a dye fixing layer under heat in the presence of a hydrophilic thermal solvent, the transfer of the diffusible dye formed may begin simultaneously with the release of the dye, or alternatively, the transfer may begin after the completion of the release of the dye. Accordingly, heating to transfer the dye formed may be carried out after heat development or at the same time as heat development.

Heating to accomplish transfer of the dye formed is carried out at a temperature within a range of about 60° C. to 250° C., in view of the preservability of the photographic material and the operability of the treatment, and therefore, a dye transfer assistant is suitably selected and used in the present invention, which acts as a hydrophilic thermal solvent in this temperature range. It is required that the hydrophilic thermal solvent under heat rapidly accomplishes the transfer of the dye formed. Additionally in consideration of the heat resistance of the photographic material, the hydrophilic thermal solvent is required to have a melting point falling within the range of about 40° C. to 250° C., preferably about 40° C. to 200° C., more preferably about 40° C. to 150° C.

The hydrophilic thermal solvents are solid at room temperature but become liquid under heat, and have the following physical characteristics: (a) an (inorganic aptitude/organic aptitude) of at least about 1; and (b) water solubility at room temperature of at least about 1. The terms "inorganic aptitude" and "organic aptitude" as used herein refer to physicochemical properties as determined and defined by the method described in *Chemical Region,* Vol. 11, page 719 (1957). In the present invention, useful hydrophilic thermal solvents must satisfy the indispensable condition of an (inorganic aptitude/organic aptitude) of about 1 or more, preferably about 2 or more.

Regarding the size of the hydrophilic thermal solvents used in the present invention, it is considered preferable that the solvent molecules which may diffuse by themselves exist around the dye molecules which are to diffuse to a dye fixing layer and that the solvent molecules do not hinder the diffusion of the dye molecules. Accordingly, it is preferred that the molecular weight of the hydrophilic thermal solvent is low, and is preferably about 200 or less, more preferably about 100 or less.

The necessary action of the hydrophilic thermal solvent is only to substantially assist the transfer of the hydrophilic dye formed by heat development to the dye fixing layer, and, therefore, the solvent may be incorporated in any layer of the photographic material in order to provide transfer assistant action. For instance, the solvent may be incorporated in the dye fixing layer, or may be incorporated in a light-sensitive layer of the light-sensitive element, or may be incorporated in both of the dye fixing layer and the light-sensitive layer. In addition, an independent layer containing the hydrophilic thermal solvent may be provided in the light-sensitive element and/or the dye fixing element. In order to increase the efficiency of the transfer of dye formed to the dye fixing layer, it is preferred that the hydrophilic thermal solvent is incorporated in the dye fixing layer and/or the adjacent layer(s).

The hydrophilic thermal solvent is generally dissolved in water and then dispersed in a binder, or if necessary, it may be dissolved in an alcohol such as methanol or ethanol and thereafter dispersed in a binder.

Examples of the hydrophilic thermal solvents which may be used in the present invention include ureas, pyridines, amides, sulfonamides, imides, alcohols, oximes and other heterocyclic compounds.

Examples of especially preferred hydrophilic thermal solvents among the above mentioned compounds are described in Japanese Patent Application (OPI) No. 42092/83 (pp. 149–158).

The hydrophilic thermal solvent may be used alone or in a mixture of two or more solvents.

The amount of the hydrophilic thermal solvent used in the present invention is from about 5 to 500 wt%, preferably from about 20 to 200 wt%, and more preferably from about 30 to 150 wt%, of the total coating amount of the light-sensitive material.

In the light-sensitive material of the present invention, the light-sensitive element and the dye fixing element are provided on a support in such relation that a diffusible dye imagewise formed in the light-sensitive element by heat development may transfer or diffuse to and permeate the dye fixing element from the light-sensitive element. Accordingly, if a plastic support is used, which is generally impermeable to the dye formed, it is necessary that at least one pair of a light-sensitive element and a dye fixing element be provided on the same side of the support and that these elements are either in direct contact or connected by another layer or support which is permeable to the diffusible image forming dye.

The light-sensitive materials of the present invention may be used to form a black-and-white image by suitable selection of the dye, but are used more preferably for formation of a color image. In order to obtain colors of a broad range in chromaticity diagram using three primary colors of yellow, magenta and cyan dyes in a subtractive mixing color process, the light-sensitive element used in the photographic material of the present invention typically has at least three silver halide emulsion layers each having a light sensitivity in a different spectral range.

Typical combinations of the three light-sensitive silver halide emulsion layers each having a light sensitivity in a different spectral range are a combination of a blue-sensitive emulsion layer, a green-sensitive emulsion layer and a red-sensitive emulsion layer, a combination of a green-sensitive emulsion layer, a red-sensitive emulsion layer and an infrared light-sensitive emulsion layer, a combination of a blue-sensitive emulsion layer, a green-sensitive emulsion layer and an infrared light-sensitive emulsion layer, and a combination of a blue-sensitive emulsion layer, a red-sensitive emulsion layer and an infrared light-sensitive emulsion layer. The term "infrared light-sensitive emulsion layer" as used herein means an emulsion layer having a light sensitivity to light having a wavelength of 700 nm or more, especially 740 nm or more.

The light-sensitive material of the present invention may have two or more emulsion layers having a light sensitivity in the same spectral range, if necessary, but having a different degree of sensitivity.

It is necessary that each of the above described three light-sensitive emulsion layers and/or the adjacent light-insensitive hydrophilic colloid layers have one substance selected from a dye providing substance capable of releasing or forming a yellow hydrophilic dye, a dye providing substance capable of releasing or forming a magenta hydrophilic dye and a dye providing substance capable of releasing or forming a cyan hydrophilic dye. In other words, it is necessary that each of the light-sensitive silver halide emulsion layers and/or the adjacent light-insensitive hydrophilic colloid layers have a dye providing substance which releases or forms a different hydrophilic dye having a different hue than the dye in the remaining two layers. If desired, two or more dye providing substances having the same hue may be used together in the same layer. In particular, when a dye providing substance used is colored, it is advantageous to provide a separate layer containing the colored dye providing substance apart from the above described emulsion layers.

FIGS. 1 to 9 show typical embodiments of various layer structures of light-sensitive elements of the present invention, although the present invention is not to be construed as being limited thereto. FIG. 1 shows one embodiment of a red-sensitive emulsion layer RL(C) containing a cyan dye providing substance, an intermediate layer IL, a green-sensitive emulsion layer GL(M) containing a magenta dye providing substance, an intermediate layer IL, a blue-sensitive emulsion layer BL(Y) containing a yellow dye providing substance and a protective layer PC, provided on a support S in this order. If the yellow dye providing substance contained in the layer BL(Y) is itself colored yellow, a yellow filter layer may be omitted as in the embodiment of FIG. 1. However, if the yellow coloration of the yellow dye providing substance itself is insufficient or if the dye providing substance is colorless, the intermediate layer between the layers BL(Y) and GL(M) may contain a colloidal silver or a yellow dye, to form a yellow filter layer YF, as shown in FIG. 2. FIG. 3 shows another embodiment where the order of the layers GL(M) and RL(C) in FIG. 1 are reversed.

FIG. 4 shows one embodiment composed of an infrared light-sensitive emulsion layer IRL(C) containing a cyan dye providing substance, an intermediate layer IL, a red-sensitive emulsion layer RL(M) containing a magenta dye providing substance, an intermediate layer IL, a green-sensitive emulsion layer GL(Y) containing a yellow dye providing substance and a protective layer PC, provided on a support S in this order. FIG. 5 shows a modification of the layer structure of FIG. 4, in which the dye providing substances contained in the infrared light-sensitive emulsion layer and the red-sensitive emulsion layer of FIG. 4 are exchanged, and thus, a red-sensitive emulsion layer RL(C) containing a cyan dye providing substance is provided on an infrared light-sensitive emulsion layer IRL(M) containing a magenta dye providing substance, separated by an intermediate layer IL, in the layer structure illustrated in FIG. 5. FIG. 6 shows another modification, where the order of the layers IRL(M) and RL(C) in FIG. 5 are reversed. FIG. 7 shows still another modification of the embodiment shown in FIG. 4, in which an antihalation layer AHL and an intermediate layer IL are provided between the layer IRL(C) and the support S.

FIG. 8 shows an embodiment of a layer structure in which each dye providing substance is incorporated in a light-insensitive hydrophilic colloid layer, which is adjacent to a corresponding light-sensitive emulsion layer, or in other words, the layer structure of FIG. 8 is composed of a light-insensitive layer CL containing a cyan dye providing substance, a red-sensitive emulsion layer RL, an intermediate layer IL, a light-insensitive layer ML containing a magenta dye providing substance, a green-sensitive emulsion layer GL, an intermediate layer IL, a light-insensitive layer YL containing a yellow dye providing substance, a blue-sensitive emulsion layer BL and a protective layer PC, provided on a support S in this order.

FIG. 9 shows a still another variation of FIG. 1, in which the order of the layers BL(Y) and RL(C) are exchanged in the layer structure.

In the above embodiments, each of the protective layer and the intermediate layer is composed of one layer as shown in the figures. However, each of these layers may be composed of two or more layers. In particular, it is advantageous that the protective layer is composed of more than one layer, especially two layers, for various purposes of preventing adhesion, preventing static charge, and absorption of any undesired UV light.

The protective layer may contain conventional additives for purposes of preventing adhesion or static charge. Examples of such additives are organic or inorganic matting agents, antistatic agents, sliding agents, UV absorbents, fluorescent bleaching agents, mordanting agents.

The intermediate layer may contain conventional additives, such as a reducing agent for prevention of color stain, a UV absorbent, a white pigment such as $TiO_2$. The white pigment may be added not only to the intermediate layer but also to the other emulsion layer(s), for the purpose of increasing the sensitivity thereof.

Additional auxiliary layers may be provided on the light-sensitive element of the present invention, if desired, including an antistatic layer, an anticurling layer, a matting agent layer.

In order to impart the necessary color sensitivity to each of the silver halide emulsions as described above, each of the silver halide emulsions may be subjected to color sensitization with a conventional sensitizing dye, to impart the necessary spectral sensitivity to each silver halide emulsion.

The light-sensitive element having a layer structure shown in each of FIGS. 1 to 8 is suitably exposed to light through the protective layer PC and FIGS. 1 and 4 show most suitable layer structures. However, in other embodiments, the support S is tranaparent, and the light-sensitive element may be exposed to light through the transparent support S. The most preferred embodiment for the light exposure through the support S is the layer structure of FIG. 9.

The layer structures of FIGS. 4 to 7, each having color-sensitive emulsions of IRL, RL and GL, are suitable embodiments which may be exposed to light especially from an LED (light emitting diode) light source or a semiconductor laser, the light for exposure being appropriately modulated (or strong-weak modulated or on-off modulated) by means of an electric signal.

In the light-sensitive element of the present invention, a transparent or non-transparent heating element may be provided, if desired, and any conventional technique may be used to provide the resistance heating element in the present light-sensitive element.

For instance, in order to provide a resistance heating element in the present light-sensitive element, a thin film made of an inorganic semiconductive material can be incorporated, or alternatively, an organic thin film containing a dispersion of electroconductive fine grains dispersed in a binder can be incorporated. Inorganic materials which may be used in the first film include silicon carbide, molybdenum silicate, lanthanum chromate, barium titanate ceramic which is used as a PTC thermistor, tin oxide, zinc oxide. A transparent or non-transparent thin layer may be made from these materials in a conventional manner. The electroconductive fine grains used in the organic thin film include metal fine grains, carbon black or graphite which are dispersed in a rubber, synthetic polymer or gelatin, to obtain a resistance heating element having desired temperature characteristics. The resistance heating element may be in direct contact with the light-sensitive element, or may be separated by a support or an intermediate layer.

In the light-sensitive material of the present invention, a dye fixing element is laminated on the light-sensitive element shown in FIGS. 1 to 9, and the dye fixing element is typically provided adjacent to the protective layer, the support or the antihalation layer of the light-sensitive element.

Preferred embodiments of the laminate type heat developable light-sensitive materials of the present invention are illustrated in FIGS. 10 to 21, which, however, are not to be construed as in any way limiting the scope of the present invention. In FIGS. 10 to 21, Em is a light-sensitive element comprising a plurality of layers as illustrated in more detail in FIGS. 1 through 9, PC is a protective layer, CB is a resistance heating element layer (in which T designates transparent and O designates opaque), R is a dye fixing layer, W is a white reflection layer, P is a peeling layer, S is a support (in which T is a transparent support and O is an opaque support), and HS is a layer containing a dye transfer assistant. In the layer structures as shown in FIGS. 10 to 21, the light-sensitive element Em may freely be selected from those of FIGS. 1 to 9, which are explained in detail above.

FIG. 10 shows an embodiment containing a light-sensitive element Em, a white reflection layer W such as gelatin dispersion of titanium dioxide, a dye fixing layer R and a protective layer PC, provided on a transparent support S(T) in this order. FIG. 11 shows another embodiment containing Em, a peeling layer P, W and R, provided on a support S(T) in this order, and after development treatment, Em and S can be peeled off together, P as a boundary. FIG. 12 shows a modification of the layer structure of FIG. 11, in which a protective layer PC is provided on the layer R. FIG. 13 shows another modification of the layer structure of FIG. 11, in which a layer containing a dye transfer assistant HS and the white reflection layer of FIG. 11 are exchanged, and further a transparent support S(T) is provided on the layer R of FIG. 11. FIG. 14 shows a modification of the layer structure of FIG. 13, in which the support on the side of Em of FIG. 13 is an opaque support S(O). FIG. 15 shows still another embodiment containing layers Em, P, R and an opaque support S(O), providing on a transparent support S(T) in this order. FIG. 16 shows a further embodiment containing a transparent support S(T) having on one side thereof a layer CB(T) and on the opposite side thereof layers Em, W, R and PC in this order.

FIG. 17 shows a still further embodiment containing a transparent or opaque support S(T or O) having on one side thereof a layer CB(O) and on the opposite side thereof layers Em, P, R and S(T) in this order. FIG. 18 shows yet another embodiment containing layers R, P, Em and PC, provided on a transparent or opaque support S(T or O) in this order. FIG. 19 shows a modification of the layer structure of FIG. 18, in which the support is an opaque support S(O) and on the opposite side thereof a transparent or opaque resistance heating element layer CB(T or O). FIG. 20 shows yet further embodiment containing a transparent support S(T) having on one side thereof a transparent resistance heating element layer CB(T) and on the opposite side thereof layers R, W, Em and PC in this order. FIG. 21 shows additional embodiment containing layers CB(T or O), W, R, P, Em and PC, provided on a support S(T or O) in this order.

The heat developable light-sensitive material having a layer structure shown in each of FIGS. 10, 11, 12, 15 and 16 is suitably exposed to light through the support S (or the resistance heating element layer CB and the support S) on the side of the light-sensitive element Em. FIG. 13 is also suitably exposed to light through the support S on the side of Em. However, the heat developable light-sensitive material having a layer structure shown in each of FIGS. 14 and 17 is suitably exposed to light through the support S on the side of the layer R. Further, the heat developable light-sensitive material having a layer structure shown in each of FIGS. 18 to 21 is suitably exposed to light through the protective layer PC.

The layer structures of the light-sensitive materials of the present invention may include still further constitutions as described in Japanese Patent Application (OPI) No. 67840/81, Canadian Pat. No. 674,082, U.S. Pat. Nos. 3,730,718, 2,983,606, 3,362,819, 3,362,821 and 3,415,644.

The light-sensitive materials of the present invention preferably contain a reductive substance, including conventional reducing agents and the above described dye providing substances having reductivity. In addition, reducing agent precursors may also be used, which themselves do not have any reductivity but may develop reductivity due to the action of a nucleophilic reagent or under heat during development.

Examples of reducing agents which may be used in the present invention include inorganic reducing agents such as sodium sulfite or sodium hydrogensulfite; benzenesulfinic acids, hydroxylamines, hydrazines, hydrazides, borane/amine complexes, hydroquinones, aminophenols, catechols, p-phenylenediamines, 3-pyrazolidinones, hydroxytetronic acids, ascorbic acids and 4-amino-5-pyrazolones. In addition, other reducing agents as described in T. H. James, *The Theory of the Photographic Process*, pp. 291–334 (4th Ed., 1977) may also be used. Moreover, reducing agent precursors described in Japanese Patent Application (OPI) Nos. 138736/81 and 40245/82 and U.S. Pat. No. 4,330,617 may also be used. Furthermore, combinations of various kinds of developing agents as illustrated in U.S. Pat. No. 3,039,869 may also be used in the present invention.

In the light-sensitive material of the present invention, the amount of the reducing agent to be added is about 0.01 to 20 mols, especially preferably about 0.1 to 10 mols, per mol of silver contained in the light-sensitive material.

In the present invention, various kinds of development stopping agents may be used for the purpose of consistently obtaining a desired image quality, irrespective of any variation in treatment temperature and treatment time during heat development.

The term "development stopping agent" as used herein designates a compound which may rapidly neutralize a base or react therewith, after completion of sufficient development, to lower the base concentration in the photographic film and thereby to stop the development, or a compound which may mutually react with the existing silver or silver salt thereby to inhibit the development reaction. Examples of such development stopping agents are acid precursors capable of releasing an acid under heat, electrophilic compounds capable of reacting (by a substitution reaction) with a coexisting base under heat, nitrogen-containing heterocyclic compounds and mercapto compounds. Specific examples of acid precursors are oxime esters as described in Japanese Patent Application (OPI) No. 108837/85 and Japanese Patent Application No. 48305/84 (U.S. patent application Ser. No. 711,885, filed on Mar. 14, 1985), and compounds capable of releasing an acid by Rossen rearrangement as described in Japanese Patent Application No. 85834/84 (U.S. patent application Ser. No. 727,718, filed on Apr. 26, 1985). Specific examples of electrophilic compounds capable of reacting with a coexisting base under heat by a substitution reaction are described in Japanese Patent Application No. 85836/84 (U.S. patent application Ser. No. 727,978, filed on Apr. 26, 1985).

It is especially preferred that the development stopping agent used in the present invention contain a base precursor, as the effect of this agent is particularly remarkable, and the molar ratio of (base precursor)/(acid precursor) is preferably about 1/20 to 20/1, more preferably about 1/5 to 5/1.

The light-sensitive materials of the present invention may further contain additional compounds for the purpose of activation of development and stabilization of the image formed. Examples of especially preferred compounds for these purposes are isothiuroniums such as 2-hydroxyethyl-isothiuronium trichloroacetate described in U.S. Pat. No. 3,301,678; bisisothiuroniums such as 1,8-(3,6-dioxaoctane)bis(isothiuronium trichloroacetate) described in U.S. Pat. No. 3,669,670; thiol compounds described in West German Patent Application (OLS) No. 2,162,714; thiazolium compounds such as 2-amino-2-thiazolium trichloroacetate, 2-amino-5-bromoethyl-2-thiazolium trichloroacetate described in U.S. Pat. No. 4,012,260; and compounds having an acidic 2-carboxycarboxyamide group, such as bis(2-amino-2-thiazolium)methylenebis(sulfonylacetate), 2-amino-2-thiazolium phenylsulfonylacetate, described in U.S. Pat. No. 4,060,420.

In addition, other compounds may preferably be used in the present invention, for example, azolethioethers and blocked azolylthione compounds described in Belgian Pat. No. 768,071; 4-aryl-1-carbamyl-2-tetrazolyl-5-thione compounds described in U.S. Pat. No. 3,893,859; and compounds described in U.S. Pat. Nos. 3,839,041, 3,844,788 and 3,877,940.

In the present invention, an image toning agent may optionally be used. Effective toning agents are 1,2,4-triazole, 1H-tetrazole, thiouracil, 1,3,4-thiadiazole or the like compounds. Preferred examples of these toning agents include 5-amino-1,3,4-thiadiazole-2-thiol, 3-mercapto-1,2,4-triazole, bis(dimethylcarbamyl)-disulfide, 6-methylthiouracil and 1-phenyl-2-tetrazolyl-5-thione. Especially preferred toning agents are compounds capable of forming black images.

The concentration of the toning agent incorporated in the light-sensitive material of the present invention varies, depending upon the kind of light-sensitive materials, the treatment condition employed and the kind of desired image, and other various conditions, but, in general, the amount of toning agent used is about 0.001 to 0.1 mol per mol of silver contained in the light-sensitive material.

The present light-sensitive material contains a binder in the form of a single binder or in the form of a mixture of two or more binders. The binder is preferably hydrophilic. In particular, transparent or translucent hydrophilic binders are useful, including, for example, natural substances such as proteins, e.g., gelatin, gelatin derivatives or cellulose derivatives, and polysaccharides such as starch or gum arabic; and synthetic polymer substances such as water-soluble polyvinyl compounds, e.g., polyvinylpyrrolidone or acrylamide polymer. In addition, other synthetic polymer substances may also be used as a binder, such as dispersive vinyl compounds in the form of a latex, which may especially increase the dimensional stability of the light-sensitive material.

The amount of the binder generally coated is about 20 $g/m^2$ or less, preferably about 10 $g/m^2$ or less, more preferably about 7 $g/m^2$ or less, in each layer containing the binder.

The amount of the organic solvent having a high boiling point dispersed in the binder together with a hydrophobic compound such as a dye providing substance is suitably about 1 ml or less (of solvent) in 1 g (of the binder), preferably about 0.5 ml or less (of solvent), more preferably about 0.3 ml or less (of solvent) in 1 g (of binder).

The light-sensitive element and the dye fixing element of the present invention may contain an inorganic or organic hardener, in the photographic emulsion layer(s) and/or other binder-containing layer(s) of the element(s). Examples of hardeners which may be used in the present invention include chromium salts (such as chromium alum and chromium acetate), aldehydes (such as formaldehyde, glyoxal and glutaraldehyde), N-methylol compounds (such as dimethylolurea and methyloldimethylhydantoin), dioxane derivatives (such as 2,3-dihydroxydioxane), active vinyl compounds (such as 1,3,5-triacryloyl-hexahydro-s-triazine, 1,3-vinylsulfonyl-2-propanol and 1,2-bis(vinylsulfonylacetamido)ethane), active halogeno compounds (such as 2,4-dichloro-6-hydroxy-s-triazine) and mucohalogenic acids (such as mucochloric acid and mucophenoxychloric acid). These may be used alone or as a mixture of two or more.

The support on which the light-sensitive element and the dye fixing element are provided according to the present invention must be capable of resisting the treating temperature employed in development. In general, glass, paper, metal or similar conventional materials may be used as the present support, and in addition, acetyl cellulose film, cellulose ester film, polyvinyl acetal film, polystyrene film, polycarbonate film, polyethylene terephthalate film or related films or resin materials may be used as the support. Moreover, a laminated paper support formed by lamination of a polymer such as polyethylene on paper may also be used. Polyesters as described in U.S. Pat. Nos. 3,634,089 and 3,725,070 are preferably used in the present invention.

When a dye providing substance capable of imagewise releasing a diffusible dye is used in the present invention, a dye transfer assistant may be used for the purpose of efficient diffusion of the dye formed from the light-sensitive layer to the dye fixing layer.

The dye transfer assistant may be applied to the light-sensitive material after development, or alternatively may previously be incorporated therein before development. In the former system where the dye transfer assistant is added after development, water or an inorganic basic aqueous solution containing an alkali metal salt such as sodium or potassium hydroxide may be used. In addition, a low boiling point solvent such as methanol, N,N-dimethylformamide, acetone, diisobutyl ketone or the like, or a mixed solvent comprising a low boiling point solvent and water or a basic aqueous solution may also be used therefor. In order to add the dye transfer assistant, the image receiving layer or light-sensitive layer may be wetted with the assistant.

In the latter system where the dye transfer assistant is incorporated in the light-sensitive element and/or dye fixing element, it is unnecessary to add any further dye transfer assistant. The dye transfer assistant may previously be incorporated in the element in the form of crystalline water or microcapsules, or alternatively, may be incorporated therein in the form of a precursor capable of releasing a necessary solvent at a sufficiently high temperature.

When the light-sensitive material of the present invention includes a dye providing substance of general formula (I) as described above, it is generally unnecessary to provide further irradiation preventive substance, halation preventive substance or other dyes in the light-sensitive material, since the dye providing substance is colored. A filter dye or an absorptive substance, as described in Japanese Patent Publication No. 3692/73 and U.S. Pat. Nos. 3,253,921, 2,527,583 and 2,956,879, may be present in the light-sensitive material, particularly for the purpose of improving the sharpness of the image formed. Dyes which may be used for this purpose are preferably dyes capable of being discolored by heat, and preferred dyes are described in U.S. Pat. Nos. 3,769,019, 3,745,009 and 3,615,432.

The light-sensitive materials of the present invention may optionally contain various conventional additives which are known in the field of heat developable light-sensitive materials; and in addition, may optionally have other conventional layers than the light-sensitive layers, such as an antistatic layer, an electroconductive layer, a protective layer, an intermediate layer, an AH layer and a peeling layer. Examples of additives which may be used in the light-sensitive materials of the present invention are described in *Research Disclosure,* Vol. 170 (June, 1978), No. 17029; and include, for example, a plasticizer, a sharpness improving dye, an AH dye, a sensitizing dye, a matting agent, a surfactant, a fluorescent whitening agent, a fading preventing agent or other conventional additives.

As a light source used for image exposure of the present light-sensitive material for the purpose of recording an image on the material, radiation including visible light may be used. In general, any light source which may be used in exposing a conventional color print material may be used for the image exposure of the present invention, including, for example, a tungsten lamp, a mercury lamp, a halogen lamp such as an iodine lamp, a xenon lamp, laser rays, a CRT light source, a fluorescent lamp, a light emitting diode (LED) or other conventional light source.

The heating temperature in the heat development step in the present invention is generally within a range of about 80° C. to about 250° C., and is preferably within a range of about 110° C. to about 180° C. The heating temperature in the transfer step is within a range of from room temperature to heat development temperature and is preferably a temperature from room temperature to a temperature lower than heat development temperature by about 10° C. As a heating means in the development and/or transfer step, any conventional heating means such as a simple hot plate, a hot iron or a hot roller can be used or other heating elements using carbon or titanium white may be used.

For the addition of the dye transfer assistant to the light-sensitive layer and/or the dye fixing layer, various means may be utilized; for example, a roller coating method or a wire bar coating method, as described in Japanese Patent Application No. 55907/83; a method where water is coated on the surface of a dye fixing layer by the use of a water absorptive material, as described in Japanese Patent Application (OPI) No. 181354/84; a method where beads are formed between a water repellent roller and a dye fixing layer and thereafter a dye transfer assistant is imparted thereto, as described in Japanese Patent Application (OPI) No. 181346/84; and other dip methods, extrusion methods, jetting method in which a dye transfer assistant is jetted from small orifices, a method in which pods including a dye transfer assistant are crushed, or other conventional means may be utilized.

Regarding the amount of dye transfer assistant added to the light-sensitive material of the present invention, a previously determined amount of said assistant may be added, as described in Japanese Patent Application (OPI) No. 164551/84, or alternatively, an excess and sufficient amount of the assistant is added and thereafter the amount may be appropriately regulated by squeezing any unnecessary amount of the assistant from the light-sensitive material by the use of rollers or the like under pressure or by evaporating the agent under heat.

Various conventional heating means may be used in the transfer step in the treatment of the light-sensitive material of the present invention; for example, the material may be heated by being passed through hot plates or by being contacted with hot plates (e.g., as described in Japanese Patent Application (OPI) No. 62635/75); by being contacted with hot drums or hot rollers, while rotated (e.g., as described in Japanese Patent Publication No. 10791/68); by being passed through hot air (e.g., as described in Japanese Patent Application (OPI) No. 32737/78); by being passed through an inert liquid kept at a determined temperature; or by being led along a heat source by the use of guide rollers, conveyor belt or the like guide parts (e.g., as described in Japanese Patent Publication No. 2546/69). Apart from such methods, the dye fixing elements may directly be heated by applying an electric current to an electroconductive material layer containing graphite, carbon black or a metal substance provided on said dye fixing element layer, to heat the dye fixing element layer.

The heating temperature in the transfer step is within a range of from room temperature to the temperature in the heat development step, and is preferably within a range of from about 60° C. up to a temperature lower than the heat development temperature by 10° C. or more.

The pressure applied for the adhesion of the light-sensitive element and the dye fixing element varies, depending upon various conditions and the materials used, and is preferably about 0.1 to 100 kg/cm$^2$, preferably about 1 to 50 kg/cm$^2$, for example, as described in Japanese Patent Application No. 55691/83.

Various conventional means may be utilized for pressing the two elements, for example, by introducing the two elements between a pair of rollers, or by pressing the two together with sufficiently even plates. The temperature of the rollers or plates used for pressing the two elements together may be freely chosen within a range of from room temperature to the temperature in the heat development step.

The present invention will be explained in greater detail by reference to the following examples, which, however, are not to be construed as limiting the scope of the present invention. Unless otherwise indicated, all parts, percents and ratios are by weight.

EXAMPLE 1

A silver benzotriazole emulsion was prepared as follows:

28 g of gelatin and 13.2 g of benzotriazole were dissolved in 3,000 ml of water. The formed solution was kept at 40° C. and stirred. A solution of 17 g of silver nitrate dissolved in 100 ml of water was added to the solution in the course of 2 minutes.

The pH value of this silver benzotriazole emulsion was adjusted and sedimented to remove the excess salt therefrom. Afterwards, the pH value thereof was adjusted to 6.30 to obtain 400 g of the desired silver benzotriazole emulsion.

A silver halide emulsion to be used in a fifth layer and a first layer was prepared as follows:

600 ml of an aqueous solution containing sodium chloride and potassium bromide and a silver nitrate aqueous solution (containing 0.59 mol of silver nitrate dissolved in 600 ml of water) were simultaneously added to a well stirred gelatin aqueous solution (containing 20 g of gelatin and 3 g of sodium chloride dissolved in 1,000 ml of water and warmed at 75° C.), in the course of 40 minutes at the same rate of addition. Thus, a monodispersed cubic silver chlorobromide emulsion (bromine content: 50 mol%) having an average grain size of 0.40 μm was obtained.

After the emulsion was washed with water and demineralized, 5 mg of sodium thiosulfate and 20 mg of 4-hydroxy-6-methyl-1,3,3a,7-tetraazaindene were added to the obtained emulsion and the mixture was heated at 60° C. for chemical sensitization thereof.

The yield of the emulsion formed was 600 g.

Next, a silver halide emulsion for a third layer was prepared as follows:

600 ml of an aqueous solution containing sodium chloride and potassium bromide and a silver nitrate aqueous solution (containing 0.59 mol of silver nitrate dissolved in 600 ml of water) were simultaneously added to a well stirred gelatin aqueous solution (containing 20 g of gelatin and 3 g of sodium chloride dissolved in 1,000 ml of water and warmed at 75° C.) in the course of 40 minutes at the same rate of addition. Thus, a monodispersed cubic silver chlorobromide emulsion (bromine content: 80 mol%) having an average grain size of 0.35 μm was obtained.

After the emulsion was washed with water and demineralized, 5 mg of sodium thiosulfate and 20 mg of 4-hydroxy-6-methyl-1,3,3a,7-tetraazaindene were added to the obtained emulsion and the mixture was heated at 60° C. for chemical sensitization thereof.

The yield of the emulsion formed was 600 g.

Next, a gelatin dispersion of a dye providing substance was prepared as follows:

5 g of Yellow Dye Providing Substance (1-A) (as described below), 0.5 g of 2-ethylhexyl succinate/-sodium sulfonate (as surfactant) and 10 g of triisononyl phosphate were weighed, and 30 ml of ethyl acetate was added thereto. The mixture was heated at about 60° C. and dissolved to obtain a uniform solution. The resultant solution was blended with 100 g of 10% solution of a lime-treated gelatin while being stirred, and then dispersed in a homogenizer for 10 minutes (10,000 rpm), to obtain a yellow dye providing substance dispersion.

In the same manner as above, with the exception that Magenta Dye Providing Substance (1-B) (as described below) was used instead of Yellow Dye Providing Substance (1-A), and that 7.5 g of tricresyl phosphate was used as a high boiling point solvent, a magenta dye providing substance dispersion was obtained.

In addition, a cyan dye providing substance dispersion was formed using Cyan Dye Providing Substance (1-C) (as described below), in place of Yellow Dye Providing Substance (1-A), in the same manner as mentioned above.

Using these materials, a color light-sensitive material having the multilayer structure as shown in the following Table 1 was formed. The seventh layer is a white pigment-containing reflection layer, and the eight layer is a dye fixing layer containing a mordanting agent.

TABLE 1

| | |
|---|---|
| Support: | Polyethylene terephthalate (PET) having a thickness of 100 μm |

TABLE 1-continued

| | |
|---|---|
| First Layer: | Green-Sensitive Emulsion Layer:<br>Silver chlorobromide emulsion (bromine 50 mol %, coated amount: 400 mg (silver)/$m^2$)<br>Benzenesulfonamide (coated amount: 180 mg/$m^2$)<br>Silver benzotriazole emulsion (coated amount: 100 mg/$m^2$)<br>Sensitizing Dye (1-D(1)) (coated amount: $10^{-6}$ mol/$m^2$)<br>Base precursor*3 (coated amount: 500 mg/$m^2$)<br>Yellow Dye Providing Substance (1-A) (coated amount: 400 mg/$m^2$)<br>Gelatin (coated amount: 1,000 mg/$m^2$)<br>High boiling point solvent*4 (coated amount: 800 mg/$m^2$)<br>Surfactant*2 (coated amount: 100 mg/$m^2$) |
| Second Layer: | Intermediate Layer:<br>Gelatin (coated amount: 1,200 mg/$m^2$)<br>Base precursor*3 (coated amount: 600 mg/$m^2$) |
| Third Layer: | Red-Sensitive Emulsion Layer:<br>Silver chlorobromide emulsion (bromine 80 mol %, coated amount: 300 mg (silver)/$m^2$)<br>Benzenesulfonamide (coated amount: 180 mg/$m^2$)<br>Silver benzotriazole emulsion (coated amount: 100 mg (silver)/$m^2$)<br>Sensitizing Dye (1-D(2)) (coated amount: $8 \times 10^{-7}$ mol/$m^2$)<br>Base precursor*3 (coated amount: 450 mg/$m^2$)<br>Magenta Dye Providing Substance (1-B) (coated amount: 400 mg/$m^2$)<br>Gelatin (coated amount: 1,000 mg/$m^2$)<br>High boiling point solvent*1 (coated amount: 600 mg/$m^2$)<br>Surfactant*2 (coated amount: 100 mg/$m^2$) |
| Fourth Layer: | Intermediate Layer:<br>Gelatin (coated amount: 1,000 mg/$m^2$)<br>Base precursor*3 (coated amount: 600 mg/$m^2$) |
| Fifth Layer: | Infrared Light-Sensitive Emulsion Layer:<br>Silver chlorobromide emulsion (bromine 50 mol %, coated amount: 300 mg (silver)/$m^2$)<br>Benzenesulfonamide (coated amount: 180 mg/$m^2$)<br>Silver benzotriazole emulsion (coated amount: 100 mg (silver)/$m^2$)<br>Sensitizing Dye (1-D(3)) (coated amount: $10^{-6}$ mol/$m^2$)<br>Base precursor*3 (coated amount: 500 mg/$m^2$)<br>Cyan Dye Providing Substance (1-C) (coated amount: 300 mg/$m^2$)<br>Gelatin (coated amount: 1,000 mg/$m^2$)<br>High boiling point solvent*4 (coated amount: 600 mg/$m^2$)<br>Surfactant*2 (coated amount: 100 mg/$m^2$) |
| Sixth Layer: | Gelatin (coated amount: 1,000 mg/$m^2$)<br>Base precursor*3 (coated amount: 600 mg/$m^2$) |
| Seventh Layer | Gelatin (coated amount: 2.5 g/$m^2$)<br>Titanium white ($TiO_2$ coated amount: 16 g/$m^2$)<br>Base precursor*3 (coated amount: 2.6 g/$m^2$) |
| Eighth Layer: | Gelatin (coated amount: 3 g/$m^2$)<br>Mordanting agent*5 (coated amount: 3 g/$m^2$)<br>Base precursor*3 (coated amount: |

Yellow Dye Providing Substance (1-A)

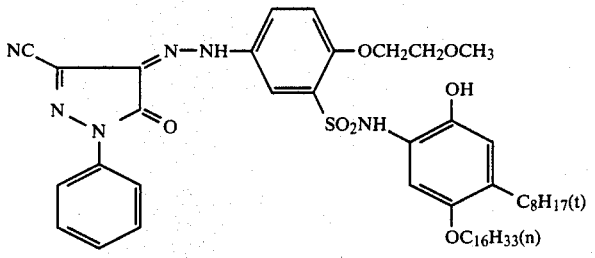

Magenta Dye Providing Substance (1-B)

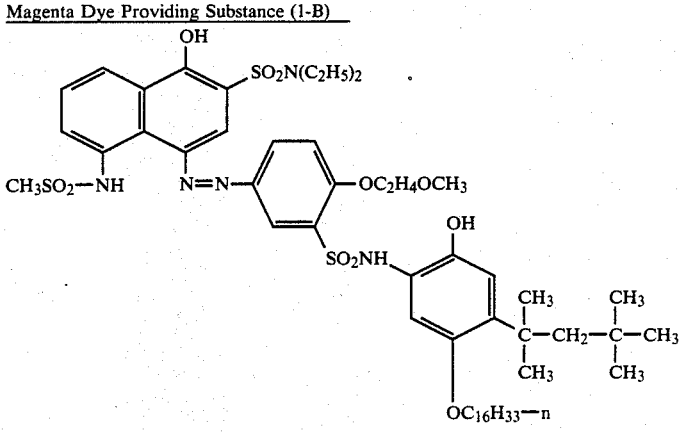

Cyan Dye Providing Substance (1-C)

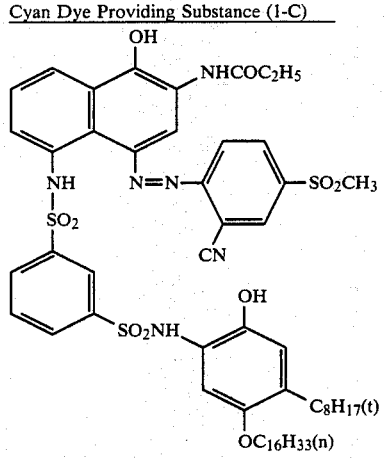

Sensitizing Dye (1-D(1))

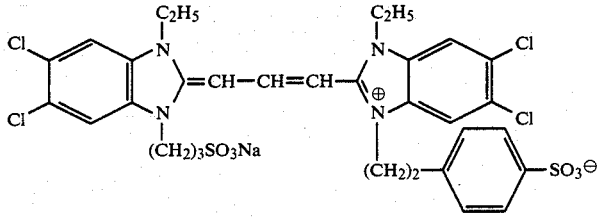

Sensitizing Dye (1-D(2))

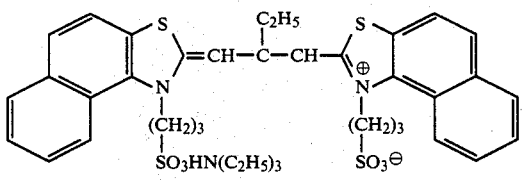

Sensitizing Dye (1-D(3))

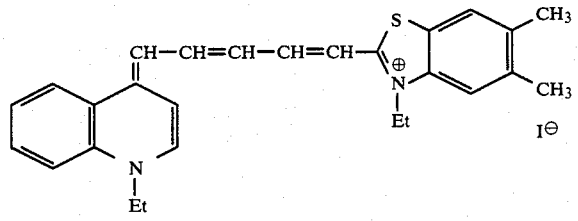

TABLE 1-continued

| |
|---|
| 1.8 g/m²) |

*[1]Tricresyl phosphate

*[2]$C_9H_{19}$—C$_6$H$_4$—O—$(CH_2CH_2O)_8$—H

*[3]Guanidine 4-methylsulfonylphenylsulfonyl acetate

*[4]Triisononyl phosphate

*[5]Poly(methyl acrylate/co-N,N,N—trimethyl-N—vinyl-benzylammonium chloride) (ratio of methyl acrylate/vinylbenzylammonium chloride = 1/1)

The color light-sensitive material of multi-layer constitution as described above was exposed using a tungsten lamp of 500 luxes through the PET support for 1 second, through a G-R-IR three color separation filter composed of a 500 to 600 nm band pass filter for G, a 600 to 700 nm band pass filter for R and a filter to pass 700 nm or more for IR, the color density in the filter being continuously varied.

After exposure, the material was uniformly heated on a heat block heated at 140° C. for 30 seconds.

Next, water was applied by wire bar to the side of the surface of the dye fixing element, in an amount of 35 ml/m$^2$. After the light-sensitive material was heated for 6 seconds on a heat block at 80° C., yellow, magenta and cyan color images were formed on the dye fixing layer, corresponding to the respective areas of the G-R-IR separation filter. The maximum density (Dmax) and the minimum density (Dmin) of each of the color images formed were measured using a Macbeth reflection densitometer (RD-519). The results are given in the following Table 2.

TABLE 2

| Separation Filter | Color Image | Dmax | Dmin | γ |
|---|---|---|---|---|
| G | Yellow | 1.80 | 0.16 | 2.0 |
| R | Magenta | 2.05 | 0.14 | 2.4 |
| IR | Cyan | 2.10 | 0.16 | 2.5 |

γ: Density difference to 10 times of exposure difference in a linear part.

From the above results, it is apparent that the present light-sensitive material having a dye fixing sheet laminated on a support may form a color image of sufficient density, S/N and gradation.

EXAMPLE 2

40 g of gelatin and 26 g of KBr were dissolved in 3,000 ml of water. The resultant solution was kept at 50° C. and stirred. Next, a solution of 34 g of silver nitrate dissolved in 200 ml of water was added to the above prepared solution in the course of 10 minutes.

Afterwards, a solution of 3.3 g of KI dissolved in 100 ml of water was added to the solution in the course of 2 minutes.

The pH value of the thus formed silver iodobromide emulsion was adjusted and sedimented to remove the excess salt therefrom.

Next, the pH value of the emulsion was adjusted to 6.0 to obtain 400 g of a silver iodobromide emulsion.

A gelatin dispersion of a dye providing substance was prepared as follows:

5 g of Yellow Dye Providing Substance (2-A) (as described below), 0.5 g of 2-ethylhexyl succinate/-sodium sulfonate (as surfactant) and 10 g of triisononyl phosphate were weighed, and 30 ml of ethyl acetate was added thereto and heated at about 60° C. and dissolved to obtain a uniform solution. The resultant solution was blended with 100 g of 10% solution of a lime-treated gelatin while being stirred, and then dispersed in a homogenizer for 10 minutes (10,000 rpm) to obtain a yellow dye providing substance dispersion.

In the same manner as above, with the exception that Magenta Dye Providing Substance (2-B) (as described below) was used instead of Yellow Dye Providing Substance (2-A), a magenta dye providing substance dispersion was obtained. In addition, a cyan dye providing substance dispersion was formed using Cyan Dye Providing Substance (2-C) (as described below), instead of Yellow Dye Providing Substance (2-A), in the same manner as mentioned above.

Using these materials, a color light-sensitive material having a multilayer constitution as shown in the following Table 3 was formed.

TABLE 3

| | |
|---|---|
| Support: | 100 μm PET |
| First Layer: | Blue-Sensitive Emulsion Layer:<br>Silver iodobromide emulsion (iodine 10 mol %, coated amount: 400 mg (silver)/m$^2$)<br>Dimethylsulfamide (coated amount: 180 mg/m$^2$)<br>Guanidine trichloroacetate (coated amount: 440 mg/m$^2$)<br>Yellow Dye Providing Substance (2-A) (coated amount: 400 mg/m$^2$)<br>Gelatin (coated amount: 1,000 mg/m$^2$)<br>High boiling point solvent*$^1$ (coated amount: 800 mg/m$^2$)<br>Surfactant*$^2$ (coated amount: 100 mg/m$^2$) |
| Second Layer: | Intermediate Layer:<br>Gelatin (coated amount: 1,200 mg/m$^2$)<br>Guanidine trichloroacetate (coated amount: 190 mg/m$^2$) |
| Third Layer: | Green-Sensitive Emulsion Layer:<br>Silver iodobromide emulsion (iodine 10 mol %, coated amount: 400 mg (silver)/m$^2$)<br>Dimethylsulfamide (coated amount: 180 mg/m$^2$)<br>Sensitizing Dye (2-D(1)) (coated amount: $10^{-6}$ mol/m$^2$)<br>Guanidine trichloroacetate (coated amount: 440 mg/m$^2$)<br>Magenta Dye Providing Substance (2-B) (coated amount: 400 mg/m$^2$)<br>Gelatin (coated amount: 1,000 mg/m$^2$)<br>High boiling point solvent*$^1$ (coated amount: 800 mg/m$^2$)<br>Surfactant*$^2$ (coated amount: 100 mg/m$^2$) |
| Fourth Layer: | Intermediate Layer:<br>Gelatin (coated amount: 1,000 mg/m$^2$)<br>Guanidine trichloroacetate (coated amount: 198 mg/m$^2$) |
| Fifth Layer: | Red-Sensitive Emulsion Layer:<br>Silver iodobromide emulsion (iodine 10 mol %, coated amount 400 mg (silver)/m$^2$)<br>Benzenesulfonamide (coated amount: 180 mg/m$^2$)<br>Sensitizing Dye (2-D(2)) (coated amount: $8 \times 10^{-7}$ mol/m$^2$)<br>Guanidine trichloroacetate (coated amount: 440 mg/m$^2$)<br>Cyan Dye Providing Substance (2-C) (coated amount: 300 mg/m$^2$)<br>Gelatin (coated amount: 1,000 mg/m$^2$)<br>High boiling point solvent*$^1$ (coated amount: 600 mg/m$^2$)<br>Surfactant*$^2$ (coated amount: 100 mg/m$^2$) |
| Sixth Layer: | Gelatin (coated amount: 1,000 mg/m$^2$)<br>Guanidine trichloroacetate (coated amount: 190 mg/m$^2$) |
| Seventh Layer: | Gelatin (coated amount: 2.5 g/m$^2$)<br>Titanium white ($TiO_2$ coated amount: 16 g/m$^2$)<br>Guanidine trichloroacetate (coated amount: 1.2 g/m$^2$) |
| Eighth Layer: | Gelatin (coated amount: 3 g/m$^2$)<br>Mordanting agent*$^3$ (coated amount: 3 g/m$^2$)<br>Guanidine trichloroacetate (coated amount: 0.9 g/m$^2$) |

*$^1$$(CSOC_9H_{19}O)_3P{=}O$

*$^2$ 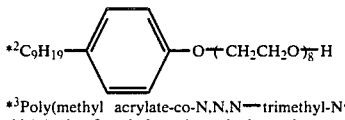

*$^3$Poly(methyl acrylate-co-N,N,N—trimethyl-N—vinyl-benzylammonium chloride) (ratio of methyl acrylate/vinylbenzylammonium chloride = 1/1)

Yellow Dye Providing Substance (2-A)

-continued

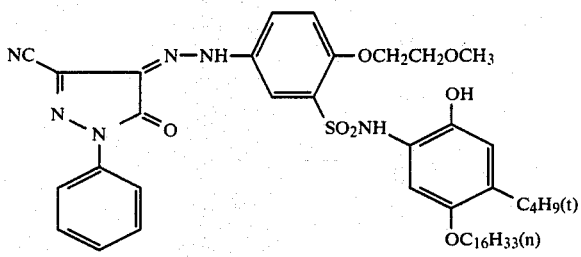

Magenta Dye Providing Substance (2-B)

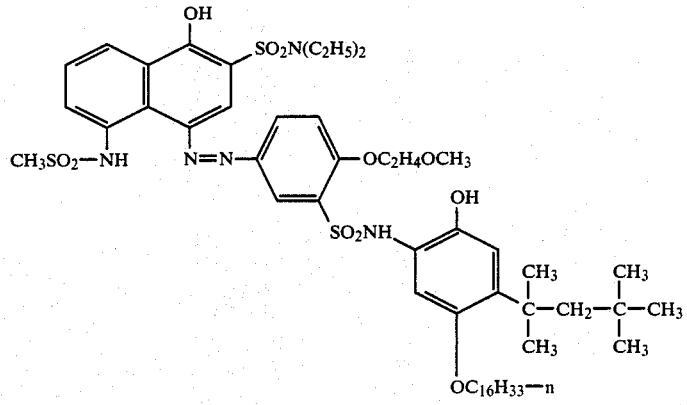

Cyan Dye Providing Substance (2-C)

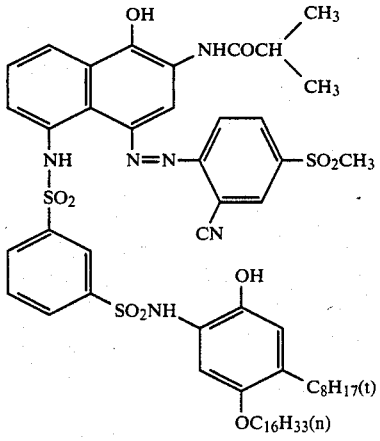

Sensitizing Dye (2-D(1))

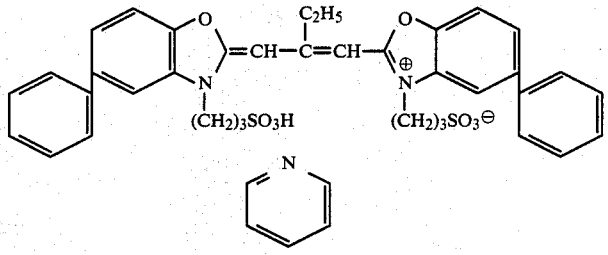

Sensitizing Dye (2-D(2))

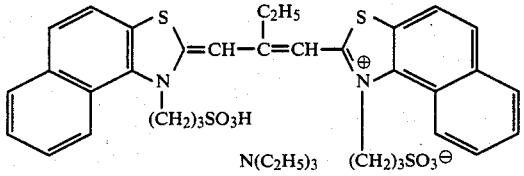

The color light-sensitive material of multi-layer structure described above was exposed to a tungsten lamp of 2,000 luxes for 10 seconds through the PET support, through a B-G-R three color separation filter having a continuously varying color density distribution. After exposure, the material was uniformly heated on a heat block heated at 130° C. for 30 seconds.

Next, water was applied by wire bar to the side of the surface of the dye fixing element in an amount of 40 ml/m$^2$. After the material was heated for 6 seconds on a heat block at 80° C., yellow, magenta and cyan color images were formed on the dye fixing layer, corresponding to the respective areas of the B-G-R separation filter. The maximum density (Dmax) and the minimum density (Dmin) of each of the color images formed were measured with a Macbeth reflection densitometer (RD-519). The results are given in the following Table 4.

TABLE 4

| Separation Filter | Color Image | Dmax | Dmin | γ* |
|---|---|---|---|---|
| B | Yellow | 1.70 | 0.15 | 1.7 |
| G | Magenta | 1.85 | 0.14 | 2.0 |
| R | Cyan | 1.90 | 0.16 | 2.1 |

γ*Density difference to 10 times of exposure difference in a linear part.

EXAMPLE 3

Using the same emulsion, dye providing substance dispersion and sensitizing dye as in Example 1, another multilayer light-sensitive material as shown in the following Table 6 was produced.

The thus produced light-sensitive material was exposed to light as in Example 1, with the exception that the exposure using the tungsten lamp was through the surface of the eighth layer. The results are given in the following Table 5.

TABLE 5

| Separation Filter | Color Image | Dmax | Dmin | γ |
|---|---|---|---|---|
| G | Yellow | 1.78 | 0.16 | 2.0 |
| R | Magenta | 1.95 | 0.13 | 2.4 |
| IR | Cyan | 2.10 | 0.17 | 2.4 |

From the results in Table 5 and those of Example 1, it is apparent that the dye fixing layer may be provided in either the uppermost layer or the undermost layer in the multilayer light-sensitive material of the present invention.

TABLE 6

| | |
|---|---|
| Eighth Layer: | Gelatin (coated amount: 1,000 mg/m$^2$) |

TABLE 6-continued

| | |
|---|---|
| | Base precursor*3 (coated amount: 600 mg/m$^2$) |
| | Silica*5 (coated amount: 100 mg/m$^2$) |
| Seventh Layer: | Green-Sensitive Emulsion Layer: |
| | Silver chlorobromide emulsion (bromine 50 mol %, coated amount: 400 mg (silver)/m$^2$) |
| | Benzenesulfonamide (coated amount: 180 mg/m$^2$) |
| | Silver benzotriazole emulsion (coated amount: 100 mg/m$^2$) |
| | Sensitizing Dye (1-D(1)) (coated amount: $10^{-6}$ mol/m$^2$) |
| | Base precursor*3 (coated amount: 500 mg/m$^2$) |
| | Yellow Dye Providing Substance (1-A) (coated amount: 400 mg/m$^2$) |
| | Gelatin (coated amount: 1,000 mg/m$^2$) |
| | High boiling point solvent*4 (coated amount: 800 mg/m$^2$) |
| | Surfactant*2 (coated amount: 100 mg/m$^2$) |
| Sixth Layer: | Intermediate Layer: |
| | Gelatin (coated amount: 1,200 mg/m$^2$) |
| | Base precursor*3 (coated amount: 600 mg/m$^2$) |
| Fifth Layer: | Red-sensitive Emulsion Layer: |
| | Silver chlorobromide emulsion (bromine 80 mol %, coated amount: 300 mg (silver)/m$^2$) |
| | Benzenesulfonamide (coated amount: 180 mg/m$^2$) |
| | Silver benzotriazole emulsion (coated amount: 100 mg (silver)/m$^2$) |
| | Sensitizing Dye (1-D(2)) (coated amount: $8 \times 10^{-7}$ mol/m$^2$) |
| | Base precursor*3 (coated amount: 450 mg/m$^2$) |
| | Magenta Dye Providing Substance (1-B) (coated amount: 400 mg/m$^2$) |
| | Gelatin (coated amount: 1,000 mg/m$^2$) |
| | High boiling point solvent*1 (coated amount: 600 mg/m$^2$) |
| | Surfactant*2 (coated amount: 100 mg/m$^2$) |
| Fourth Layer: | Intermediate Layer: |
| | Gelatin (coated amount: 1,000 mg/m$^2$) |
| | Base precursor*3 (coated amount: 600 mg/m$^2$) |
| Third Layer: | Infrared Light-Sensitive Emulsion Layer: |
| | Silver chlorobromide emulsion (bromine 50 mol %, coated amount: 300 mg (silver)/m$^2$) |
| | Benzenesulfonamide (coated amount: 180 mg/m$^2$) |
| | Silver benzotriazole emulsion (coated amount: 100 mg (silver)/m$^2$) |

TABLE 6-continued

| | |
|---|---|
| | Sensitizing Dye (1-D(3)) (coated amount: $10^{-6}$ mol/m$^2$) |
| | Base precursor*3 (coated amount: 500 mg/m$^2$) |
| | Cyan Dye Providing Substance (1-C) (coated amount: 300 mg/m$^2$) |
| | Gelatin (coated amount: 1,000 mg/m$^2$) |
| | High boiling point solvent*4 (coated amount: 600 mg/m$^2$) |
| | Surfactant*2 (coated amount: 100 mg/m$^2$) |
| Second Layer: | Gelatin (coated amount: 2.5 g/m$^2$) |
| | Titanium white ($TiO_2$ coated amount: 16 g/m$^2$) |
| | Base precursor*3 (coated amount: 2.6 g/m$^2$) |
| First Layer: | Dye Fixing Layer: |
| | Gelatin (coated amount: 3 g/m$^2$) |
| | Mordanting agent*6 (coated amount: 3 g/m$^2$) |
| | Base precursor*3 (coated amount: 1.8 g/m$^2$) |
| Support: | PET having a thickness of 100 μm |

*1Tricresyl phosphate

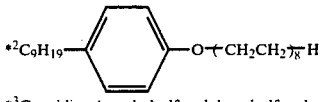

*3Guanidine 4-methylsulfonylphenylsulfonyl acetate
*4Triisononyl phosphate
*5Size: 4 μm
*6Poly(methyl acrylate-co-N,N,N—trimethyl-N—vinyl-benzylammonium chloride) (ratio of methyl acrylate/vinylbenzylammonium chloride = 1/1)

EXAMPLE 4

In the same manner as in Example 1, with the exception that the amount of the base precursor used in each of the seventh layer and the eighth layer were varied as shown below, laminate type Light-Sensitive Materials (4A) through (4F) were manufactured, each of which was photographically exposed and treated in the same manner as in Example 1. The results are given in the following Table 7.

TABLE 7

| Sample No. | Amount of Base Precursor 7th Layer (g/m$^2$) | Amount of Base Precursor 8th Layer (g/m$^2$) | Separation Filter | Color Image | Dmax | Dmin | γ |
|---|---|---|---|---|---|---|---|
| 4A | 0 | 0 | G | Yellow | 0.3 | 0.10 | — |
| | | | R | Magenta | 0.4 | 0.10 | — |
| | | | IR | Cyan | 0.9 | 0.13 | — |
| 4B | 1.3 | 0.9 | G | Yellow | 1.20 | 0.12 | 1.3 |
| | | | R | Magenta | 1.60 | 0.13 | 1.7 |
| | | | IR | Cyan | 1.75 | 0.14 | 2.2 |
| 4C | 2.6 | 1.8 | G | Yellow | 1.80 | 0.16 | 2.0 |
| | | | R | Magenta | 2.05 | 0.14 | 2.4 |
| | | | IR | Cyan | 2.10 | 0.16 | 2.5 |
| 4D | 3.9 | 2.7 | G | Yellow | 1.95 | 0.20 | 2.1 |
| | | | R | Magenta | 2.20 | 0.18 | 2.3 |
| | | | IR | Cyan | 2.26 | 0.19 | 2.4 |
| 4E | 3.9 | 0 | G | Yellow | 1.65 | 0.15 | 1.8 |
| | | | R | Magenta | 1.90 | 0.14 | 2.2 |
| | | | IR | Cyan | 2.01 | 0.15 | 2.2 |
| 4F | 0.9 | 0.3 | G | Yellow | 1.05 | 0.12 | 1.1 |
| | | | R | Magenta | 1.40 | 0.12 | 1.5 |
| | | | IR | Cyan | 1.55 | 0.13 | 1.8 |

Among the above samples, no remarkable increase of density was observed in Sample No. 4A, when the development temperature was raised to 150° C. for 30 seconds. On the contrary, a remarkable increase of density was observed in Sample Nos. 4B and 4F, and the results obtained for these two samples were almost the same as that for Sample No. 4C which was heated at 140° C. for 30 seconds in development. From these results, therefore, it is seen that in the laminate type heat developable light-sensitive material having the light-sensitive element and the dye fixing element which comprises the white reflection layer and the mordanting layer in this example, the addition of a base precursor to dye fixing element is important to obtain Dmax highly.

The addition of a large amount of a base precursor often results in a disadvantage such as occurrence of cracks in the layer which was added a large amount of a base precursor. In order to overcome this problem, it is effective to add an organic solvent having a high boiling point to the white reflection layer, as illustrated in the following Example 5.

EXAMPLE 5

When a large amount of a base precursor is incorporated in layers of the present light-sensitive material as in Sample No. 4D in Example 4, the white reflection layer is often observed to crack. In order to avoid such a defect, a dispersion of an organic solvent having a high boiling point was added to the white reflection layer (seventh layer) in Sample No. 4D as shown below, the remaining layers being the same as those of Sample No. 4D, to obtain Sample Nos. 5A through 5F. These samples were exposed and processed as in Example 1 to obtain the results shown in the following Table 8.

TABLE 8

| Sample No. | Dispersion Compound | Dispersion Amount ($g/m^2$) | Occurrence of Cracks |
|---|---|---|---|
| 4D | — | — | Cracked |
| 5A | Tricresyl phosphate | 0.5 | Slightly cracked |
| 5B | " | 1.0 | Not cracked |
| 5C | " | 2.0 | Not cracked |
| 5D | Dibutyl phthalate | 0.5 | Slightly cracked |
| 5E | " | 1.0 | Not cracked |
| 5F | " | 2.0 | Not cracked |

From the above results, it is apparent that the addition of an organic solvent having a high boiling point is effective to prevent the occurrence of cracks. In this connection, it is noted that the addition of a large amount of solvent is more effective, for each added solvent used.

EXAMPLE 6

In the same manner as in Example 1, with the exception that 1 g each of urea, N-methylurea, ethylurea and ethyleneurea were added to the eighth layer, and that 2.5 g each of these urea were also added to the seventh layer, a laminate type light-sensitive material was manufactured. This was exposed in the same manner as in Example 3, and then heated at 150° C. for 25 seconds using hot plate. The results are given in the following Table 9.

TABLE 9

| Separation Filter | Color Image | Dmax | Dmin |
|---|---|---|---|
| G | Yellow | 1.35 | 0.26 |
| R | Magenta | 1.64 | 0.31 |
| IR | Cyan | 1.55 | 0.24 |

The above results prove that the light-sensitive material of the present invention produces a sufficient color image, even when no water is used in the diffusion transfer of the color image formed.

EXAMPLE 7

In the same manner as in Example 3, with the exception that the second layer (white reflection layer) was changed to that given in the following Table 10, a light-sensitive material was produced. This material was exposed and heated, and thereafter water was added thereto in the same manner as in Example 3, and the light-sensitive material was heated on a heat block at 80° C. for 6 seconds. Then, the emulsion layer was physically peeled off from the support, whereby the dye fixing layer remained on the support, to obtain a sharp image thereon.

TABLE 10

| | |
|---|---|
| Eighth Layer: | Gelatin (coated amount: 1,000 $mg/m^2$)<br>Base precursor*3 (coated amount: 600 $mg/m^2$)<br>Silica*5 (coated amount: 100 $mg/m^2$) |
| Seventh Layer: | Green-Sensitive Emulsion Layer:<br>Silver chlorobromide emulsion (bromine 50 mol %, coated amount: 400 mg (silver)/$m^2$)<br>Benzenesulfonamide (coated amount: 180 $mg/m^2$)<br>Silver benzotriazole emulsion (coated amount: 100 mg (silver)/$m^2$)<br>Sensitizing Dye (1-D(1)) (coated amount: $10^{-6}$ $mol/m^2$)<br>Base precursor*3 (coated amount: 500 $mg/m^2$)<br>Yellow Dye Providing Substance (1-A) (coated amount: 400 $mg/m^2$)<br>Gelatin (coated amount: 1,000 $mg/m^2$)<br>High boiling point solvent*4 (coated amount: 800 $mg/m^2$)<br>Surfactant*2 (coated amount: 100 $mg/m^2$) |
| Sixth Layer: | Intermediate Layer:<br>Gelatin (coated amount: 1,200 $mg/m^2$)<br>Base precursor*3 (coated amount: 600 $mg/m^2$) |
| Fifth Layer: | Red-Sensitive Emulsion Layer:<br>Silver chlorobromide emulsion (bromine 80 mol %, coated amount: 300 mg (silver)/$m^2$)<br>Benzenesulfonamide (coated amount: 180 $mg/m^2$)<br>Silver benzotriazole emulsion (coated amount: 100 mg (silver)/$m^2$)<br>Sensitizing Dye (1-D(2)) (coated amount: $8 \times 10^{-7}$ $mol/m^2$)<br>Base precursor*3 (coated amount: 450 $mg/m^2$)<br>Magenta Dye Providing Substance (1-B) (coated amount: 400 $mg/m^2$)<br>Gelatin (coated amount: 1,000 $mg/m^2$)<br>High boiling point solvent*1 (coated amount: 600 $mg/m^2$)<br>Surfactant*2 (coated amount: 100 $mg/m^2$) |
| Fourth Layer: | Intermediate Layer:<br>Gelatin (coated amount: 1,000 $mg/m^2$)<br>Base precursor*3 (coated amount: 600 $mg/m^2$) |
| Third Layer: | Infrared Light -Sensitive Emulsion Layer:<br>Silver chlorobromide emulsion (bromine 50 mol %, coated amount: 300 mg (silver)/$m^2$)<br>Benzenesulfonamide (coated amount: 180 $mg/m^2$)<br>Silver benzotriazole emulsion (coated amount: 100 mg (silver)/$m^2$)<br>Sensitizing Dye (1-D(3)) (coated amount: $10^{-6}$ $mol/m^2$)<br>Base precursor*3 (coated amount: 500 $mg/m^2$)<br>Cyan Dye Providing Substance (1-C) (coated amount: 300 $mg/m^2$)<br>Gelatin (coated amount: 1,000 $mg/m^2$)<br>High boiling point solvent*4 (coated amount: 600 $mg/m^2$)<br>Surfactant*2 (coated amount: 100 $mg/m^2$) |

TABLE 10-continued

| | |
|---|---|
| Second Layer: | Polyvinyl alcohol (polymerization degree: 2,000, 2.0 g/m$^2$) |
| | Base precursor*3 (coated amount: 1.0 g/m$^2$) |
| First Layer: | Gelatin (coated amount: 3 g/m$^2$) |
| | Mordanting agent*6 (coated amount: 3 g/m$^2$) |
| | Base precursor*3 (coated amount: 1.8 g/m$^2$) |
| Support: | PET 100 μm thick |

*1Tricresyl phosphate

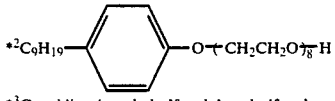

*3Guanidine 4-methylsulfonylphenylsulfonyl acetate
*4Triisononyl phosphate
*5Size (4 μm)
*6Poly(methyl acrylate-co-N,N,N—trimethyl-N—vinyl-benzylammonium chloride) (ratio of methyl acrylate/vinylbenzylammonium chloride = 1/1)

EXAMPLE 8

Using the same emulsion, dye providing substance dispersion and sensitizing dye as in Example 2, a laminate type color light-sensitive material as shown in the following Table 11 was manufactured. The backing layer of this material was an electroconductive heating element layer, and the second layer was a releasable layer. This light-sensitive material was exposed in the same manner as in Example 2, with the exception that the exposure was through the eighth layer (i.e., through the emulsion layers), and thereafter the backing layer was charged with a direct current of 300 v for 20 seconds, through electrodes having an interelectrode distance of 25 cm. Next, water was applied to the surface of the eighth layer in an amount of 30 ml/m$^2$, and then the light-sensitive material was heated on a heat block at 80° C. for 6 seconds, and thereafter the emulsion layer was physically peeled off from the support to obtain a sharp three color image on the remaining dye fixing layer.

TABLE 11

| | |
|---|---|
| Eighth Layer: | Gelatin (coated amount: 1,000 mg/m$^2$) |
| | Guanidine trichloroacetate (coated amount: 190 mg/m$^2$) |
| Seventh Layer: | Blue-Sensitive Emulsion Layer: |
| | Silver iodobromide emulsion (iodine 10 mol %, coated amount: 400 mg (silver)/m$^2$) |
| | Dimethylsulfamide (coated amount: 180 mg/m$^2$) |
| | Guanidine trichloroacetate (coated amount: 440 mg/m$^2$) |
| | Yellow Dye Providing Substance (2-A) (coated amount: 400 mg/m$^2$) |
| | Gelatin (coated amount: 1,000 mg/m$^2$) |
| | High boiling point solvent*1 (coated amount: 800 mg/m$^2$) |
| | Surfactant*2 (coated amount: 100 mg/m$^2$) |
| Sixth Layer: | Intermediate Layer: |
| | Gelatin (coated amount: 1,200 mg/m$^2$) |
| | Guanidine trichloroacetate (coated amount: 190 mg/m$^2$) |
| Fifth Layer: | Green-Sensitive Emulsion Layer: |
| | Silver iodobromide emulsion (iodine 10 mol %, coated amount: 400 mg (silver)/m$^2$) |
| | Dimethylsulfamide (coated amount: 180 mg/m$^2$) |
| | Sensitizing Dye (2-D(1)) (coated amount: $10^{-6}$ mol/m$^2$) |
| | Guanidine trichloroacetate (coated amount: 440 mg/m$^2$) |
| | Magenta Dye Providing Substance (2-B) |

TABLE 11-continued

| | |
|---|---|
| | (coated amount: 400 mg/m$^2$) |
| | Gelatin (coated amount: 1,000 mg/m$^2$) |
| | High boiling point solvent*1 (coated amount: 800 mg/m$^2$) |
| | Surfactant*2 (coated amount: 100 mg/m$^2$) |
| Fourth Layer: | Intermediate Layer: |
| | Gelatin (coated amount: 1,000 mg/m$^2$) |
| | Guanidine trichloroacetate (coated amount: 198 mg/m$^2$) |
| Third Layer: | Red-Sensitive Emulsion Layer: |
| | Silver iodobromide emulsion (iodine 10 mol %, coated amount: 400 mg (silver)/m$^2$) |
| | Benzenesulfonamide (coated amount: 180 mg/m$^2$) |
| | Sensitizing Dye (2-D(2)) (coated amount: $8 \times 10^{-7}$ mol/m$^2$) |
| | Guanidine trichloroacetate (coated amount: 440 mg/m$^2$) |
| | Cyan Dye Providing Substance (2-C) (coated amount: 300 mg/m$^2$) |
| | Gelatin (coated amount: 1,000 mg/m$^2$) |
| | High boiling point solvent*1 (coated amount: 600 mg/m$^2$) |
| | Surfactant*2 (coated amount: 100 mg/m$^2$) |
| Second Layer: | Polyvinyl alcohol (polymerization degree: 2,000, 2.2 g/m$^2$) |
| | Guanidine trichloroacetate (coated amount: 1.1 g/m$^2$) |
| First Layer: | Gelatin (coated amount: 3 g/m$^2$) |
| | Mordanting agent*3 (coated amount: 3 g/m$^2$) |
| | Guanidine trichloroacetate (coated amount: 0.9 g/m$^2$) |
| Support: | PET into which $TiO_2$ had been dispersed in advance, thickness: 100 μm |
| Backing Layer: | 80 μm Carbon black (coated amount: 10 g/m$^2$) |
| | Gelatin (coated amount: 3.3 g/m$^2$) |
| | Surfactant*2 (coated amount: 0.6 g/m$^2$) |
| | Surfactant*4 (coated amount: 1.2 g/m$^2$) |

*1$(CSOC_9H_{19}O)_3P{=}O$

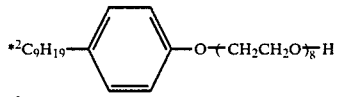

*3Poly(methyl acrylate-co-N,N,N—trimethyl-N—vinyl-benzylammonium chloride) (ratio of methyl acrylate/vinylbenzylammonium chloride = 1/1)
*4Demol N (trade name by Kao Atlas)

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support having thereon (1) a light-sensitive element containing at least one light-sensitive silver halide emulsion layer and at least one image forming substance capable of forming a diffusible dye, and (2) a dye fixing element, provided on the same side of said support, wherein said dye fixing element contains at least one of a base or base precursor plus a dispersion of a high boiling point solvent, wherein said dye fixing element comprises at least one light-reflective layer and at least one dye fixing layer, said white reflective layer containing at least one of said base or said base precursor and said dispersion of high boiling point solvent.

2. The heat developable light-sensitive material as claimed in claim 1, wherein said light-sensitive element further comprises at least a base or a base precursor and a binder.

3. The heat developable light-sensitive material as claimed in claim 1, wherein said said dye fixing element contains a hydrophilic thermal solvent.

4. The heat developable light-sensitive material as claimed in claim 1, further comprising a heating element provided on the surface of said support opposite to said light-sensitive element.

5. The heat developable light-sensitive material as claimed in claim 1, wherein said at least one of base or base precursor is contained in an amount of a 0.1 $g/m^2$ to 0.6 $g/m^2$ per $\mu m$ of coated layer film thickness of the dye fixing element.

6. The heat developable light-sensitive material as claimed in claim 1, wherein the high boiling point solvent is contained in an amount of 0.25 $g/m^2$ to 10 $g/m^2$.

7. The heat developable light-sensitive material as claimed in claim 1, wherein said high boiling point solvent has a boiling point of more than 160° C.

8. The heat developable light-sensitive material as claimed in claim 1, wherein said high boiling point solvent is selected from the group consisting of an alkyl phthalate, a phosphate, a citrate, a benzoate, an alkylamide, a fatty acid ester and a trimesate.

9. The heat developable light-sensitive material as claimed in claim 8, wherein said high boiling point solvent is contained in an amount of 0.5 $g/m^2$ to 5 $g/m^2$.

10. The heat developable light-sensitive material as claimed in claim 1, wherein said dispersion of a high boiling point solvent is added to a layer containing at least one of said base or base precursor.

11. The heat developable light-sensitive material as claimed in claim 1, wherein said dye fixing element contains at least one of the base or base precursor in an amount sufficient to provide high image density and a dispersion of a high boiling point solvent in an amount sufficient to prevent cracking.

* * * * *